US006886559B2

(12) United States Patent
McDonald et al.

(10) Patent No.: US 6,886,559 B2
(45) Date of Patent: May 3, 2005

(54) MULTI-PHASE HEADSET FOR PILOTS

(75) Inventors: Thomas K. McDonald, Overland Park, KS (US); Gary R. Hannah, Shawnee, KS (US); Kirsten Frogley, Shawnee, KS (US)

(73) Assignee: BE Intellectual Property, Inc.

( * ) Notice: Subject to any disclaimer, the term of this patent is extended or adjusted under 35 U.S.C. 154(b) by 74 days.

(21) Appl. No.: 10/154,773

(22) Filed: May 24, 2002

(65) Prior Publication Data

US 2003/0000001 A1 Jan. 2, 2003

Related U.S. Application Data

(60) Provisional application No. 60/331,372, filed on Jul. 2, 2001.

(51) Int. Cl.[7] ..... A62B 17/04

(52) U.S. Cl. ..... 128/201.24; 128/201.22; 128/201.25; 128/207.11

(58) Field of Search ..... 128/201.19, 201.22, 128/201.24, 206.14, 206.12, 206.19, 206.21, 207.11, 206.27, 201.25, 202.22, 205.25, 206.23; 2/410, 5, 6.1, 6.3, 6.4, 6.5; 244/118.5, 121

(56) References Cited

U.S. PATENT DOCUMENTS

| | | | | | |
|---|---|---|---|---|---|
| 3,170,979 | A | | 2/1965 | Baldwin et al. | |
| 3,347,229 | A | * | 10/1967 | Heitman | 128/201.19 |
| 3,599,636 | A | | 8/1971 | Gutman et al. | |
| 3,683,907 | A | * | 8/1972 | Cotabish | 128/200.28 |
| 3,833,935 | A | * | 9/1974 | Ansite et al. | 2/6.2 |
| 3,910,269 | A | | 10/1975 | Ansite et al. | |
| 4,915,106 | A | | 4/1990 | Aulgur et al. | |
| 5,078,130 | A | | 1/1992 | Van Oosten | |
| 5,091,719 | A | | 2/1992 | Beamon, III | |
| 5,297,297 | A | * | 3/1994 | Pei | 2/424 |
| 5,420,828 | A | | 5/1995 | Geiger | |
| 5,664,566 | A | | 9/1997 | McDonald et al. | |
| 5,697,363 | A | * | 12/1997 | Hart | 128/201.24 |
| 5,901,369 | A | * | 5/1999 | Pilney | 2/6.5 |
| 6,078,427 | A | | 6/2000 | Fontaine et al. | |
| 6,097,353 | A | | 8/2000 | Melville et al. | |
| 6,137,457 | A | | 10/2000 | Tokuhashi et al. | |
| 6,157,291 | A | | 12/2000 | Kuenster et al. | |
| 6,226,803 | B1 | * | 5/2001 | Tanaka | 2/424 |
| 6,247,470 | B1 | * | 6/2001 | Ketchedjian | 128/200.28 |
| 6,318,309 | B1 | * | 11/2001 | Burrahm et al. | 128/857 |

OTHER PUBLICATIONS

Internet article "Microvision and R RAMJET Team to Develop Safer Cockpit Emergency Display System" Oct. 3, 2001.

* cited by examiner

*Primary Examiner*—Glenn K. Dawson
*Assistant Examiner*—Darwin P Erezo
(74) *Attorney, Agent, or Firm*—Hovey Williams LLP

(57) ABSTRACT

A multi-phase headset (50) for aircraft crew members is provided which includes an inflatable gas mask unit (54) and a visor unit (56), supported on the head of a user (60) by mounting assembly (52). The overall headset (50) also has a selectively and/or automatically operable motive and control assembly (60). Preferably; the mounting assembly (52) includes a pair of ear pieces (62, 64) and a strap assembly (66) to allow positioning of the headset (50) on the user's head, with the mask and visor units (54, 56) adjacent the crown of the user's head. In the event of an emergency, the mask unit (54) is lowered and the mask body (124) is inflated for delivery of breathable gas to the user (60). Also, the visor unit (56) may be lowered to a use position atop mask unit (54). The pneumatically or electrically operated motive and control assembly (60) serves to move the mask and visor units (54, 56) between their retracted and deployed position. In order to prevent ingress of smoke, physical seals or air curtain passageways (144, 286) may be provided along the upper and lower margins of the visor and mask units (56, 54).

89 Claims, 15 Drawing Sheets

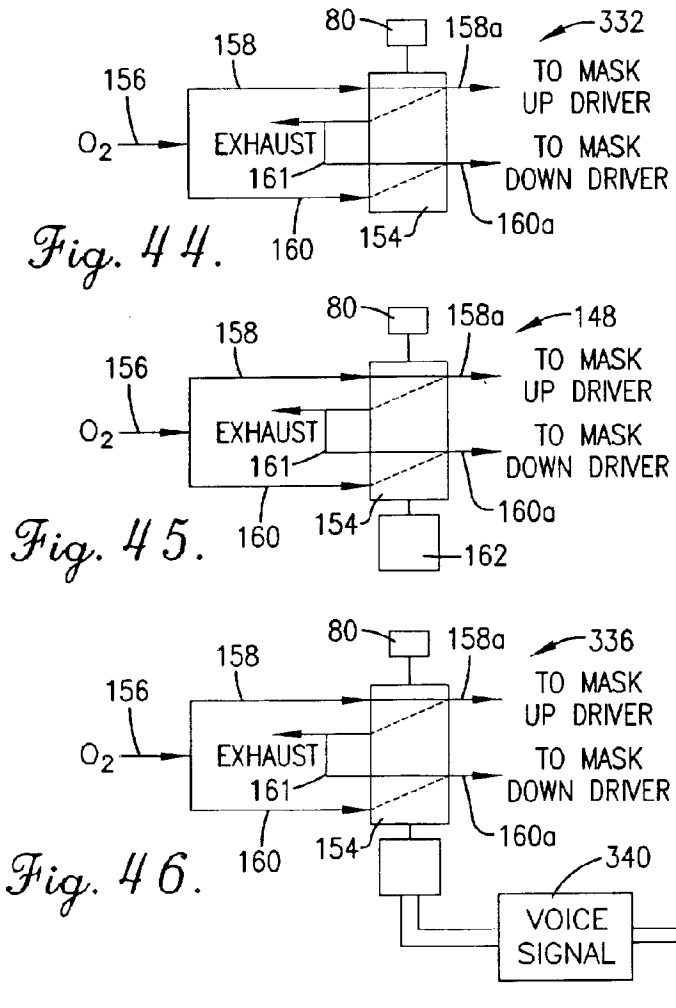
Fig. 44.
Fig. 45.
Fig. 46.
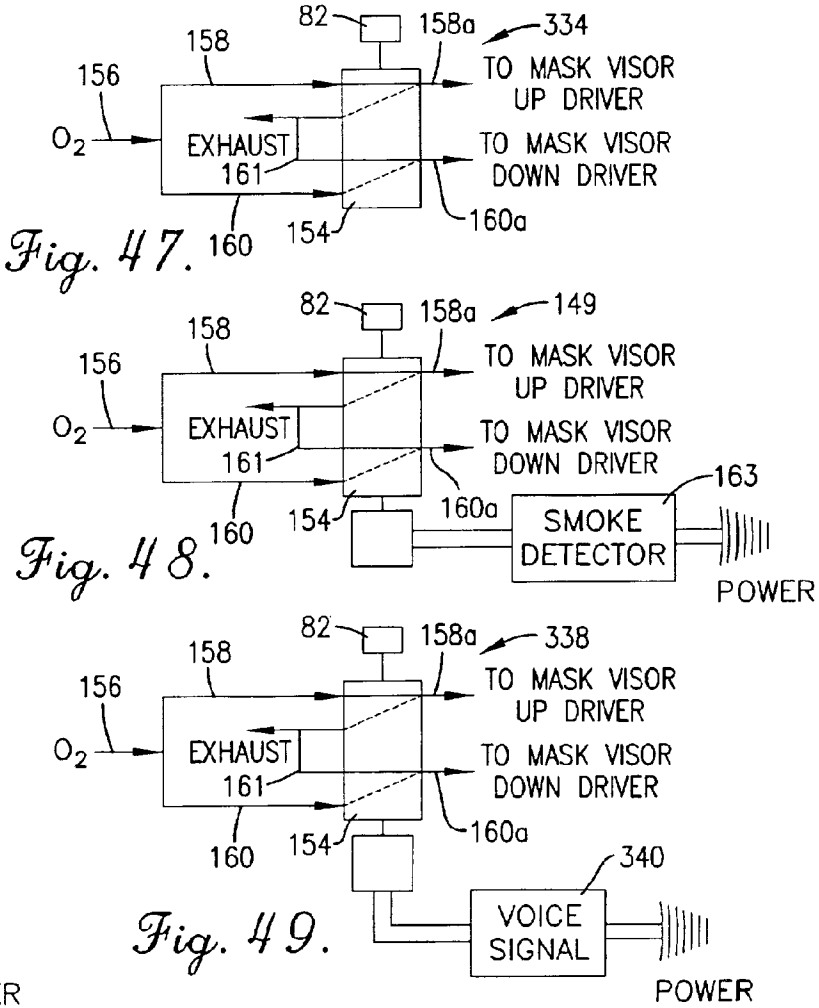
Fig. 47.
Fig. 48.
Fig. 49.

MULTI-PHASE HEADSET FOR PILOTS

RELATED APPLICATION

This application claims the benefit of provisional patent application Ser. No. 60/331,372 filed Jul. 2, 2001.

BACKGROUND OF THE INVENTION

1. Field of the Invention

The present invention is broadly concerned with improved headsets for aircraft crew members which are comfortable to wear and include shiftable mask and visor units which can be automatically or manually moved from a retracted position over the crown of the wearer's head to lowered, deployed positions. In this way, little or no crew member effort is required in emergency situations such as flight deck depressurization or smoke in the flight deck, so that the crew may very rapidly receive breathable gas and have eye protection.

2. Description of the Prior Art

Pursuant to government regulations, passenger aircraft flight decks are provided with emergency oxygen equipment which is used by the air crew in the event of an emergency such as a depressurization or smoke in the flight deck. Such equipment generally includes a mask (either full-face or covering the nose and mouth region of a wearer) which is stowed adjacent the crew member. When an emergency occurs, the mask is grasped, pulled from stowage and donned by the crew member. The mask is coupled with an oxygen supply hose so that emergency oxygen, or an air-oxygen mixture, is delivered to the mask. Typically, emergency masks of this type must be capable of being donned within five seconds.

U.S. Pat. No. 4,915,106 describes a crew oxygen mask having an inflatable harness. That is, when the mask is pulled from stowage, the harness straps are inflated and assume a substantially enlarged configuration allowing the mask assembly to be rapidly placed over the user's head. Thereupon, a valve mechanism is actuated to deflate the harness straps so that the harness tightens and securely holds the mask in place. The '106 patent further describes a comfort control feature allowing the crew member to adjust the effective tension of the harness straps. U.S. Pat. No. 3,599,636 discloses a similar harness-inflation mask assembly.

While these types of crew oxygen masks can permit rapid mask donning, the crew member must find the mask, pull it out of stowage and put it on before the emergency can be addressed. Depending upon aircraft altitude, a slow response on the part of the crew member or failure to recognize oxygen depletion can lead to catastrophic results. Moreover, inflatable harness masks require a rather large and bulky stowage device and related equipment, which must be situated in relatively close proximity to each crew member. This takes up valuable space within the already-crowded crew flight deck, and moreover increases aircraft weight. Finally, in large commercial aircraft the oxygen hoses associated with conventional masks have become rather long, which again dictates that the stowage device must be of considerable size.

Another hazard sometimes encountered in the flight deck is the presence of smoke, which may result from an electrical fire or the like. While existing crew oxygen equipment supplies breathable gas to the crew members during smoky conditions, the presence of smoke can cause irritation to the eyes (if a half face mask is worn) or significantly obscure the crew member's vision. In light of this problem, a number of visors or other eye protective devices have been proposed. However, in many cases the supplemental smoke-protection equipment takes up still further valuable deck space and requires additional donning time. In large commercial aircraft, there are multiple locations of stowed equipment which may result in the equipment being misplaced, lost, stolen or damaged.

There is accordingly a need in the art for improved air crew emergency oxygen and smoke protection equipment which eliminates the need for separate stowage devices and long supplemental oxygen hoses typical of inflatable-harness masks, but which retain the ability to be deployed in a very rapid fashion during flight deck emergencies.

SUMMARY OF THE INVENTION

The present invention overcomes the problems outlined above and provides compact, comfortable to wear crew headsets which have selectively usable mask and visor units shiftable from upper stored positions atop the wearer's head to lowered, deployed positions. Broadly speaking, the headsets of the invention include a mounting assembly which supports the movable mask and visor units as well as a pneumatically or electrically operated motive and control assembly. Mask and visor unit movement can be effected manually or automatically via control buttons or the like, or aneroid or voice command operators, or smoke detectors.

In one preferred form, the mask unit includes an inflatable mask body or preformed face seal which when deployed will engage the nose and mouth region of the user; a gas passageway provides breathable gas to the inflated mask. The mask unit also includes means to prevent entrance of smoke into the headset. This may comprise a series of inwardly directed pressurized air curtain outlet passageways, or flexible sheet-like or bristle barriers on opposite sides of the inflatable mask.

The visor unit has a transparent lens and may also include a series of air curtain outlet passageways along the upper periphery thereof. Pressurized gas is directed to the outlet passageways to create an air curtain directed toward the user's forehead. In this way, the ingress of smoke into the visor unit is prevented. An inflatable bellows or flexible curtain may be used in lieu of the air curtain passageways for the same purpose.

Deployment of the mask and visor units is very rapid, and the necessity of physically grasping, donning and adjusting a mask in emergencies is entirely eliminated.

BRIEF DESCRIPTION OF THE DRAWINGS

FIG. 44 is a schematic illustration of one type of pneumatic controller used for selective deployment and retraction of the mask unit, with a manual valve operator;

FIG. 45 is a schematic illustration of one type of pneumatic controller used for selective deployment and retraction of the mask unit, with a manual and automatic (aneroid) valve operator;

FIG. 46 is a schematic illustration of one type of pneumatic controller used for selective deployment and retraction of the mask unit, with manual and automatic valve operators, and a voice actuated operator;

FIG. 47 is a schematic illustration of one type of pneumatic controller used for selective deployment and retraction of the visor unit, with a manual valve operator;

FIG. 48 is a schematic illustration of one type of pneumatic controller used for selective deployment and retraction of the visor unit, with a manual and automatic (smoke detector) valve operator; and FIG. 49 is a schematic illustration of one type of pneumatic controller used for selective deployment and retraction of the visor unit, with manual and automatic valve operators, and a voice actuated operator.

DETAILED DESCRIPTION OF THE PREFERRED EMBODIMENTS

Figure 2:
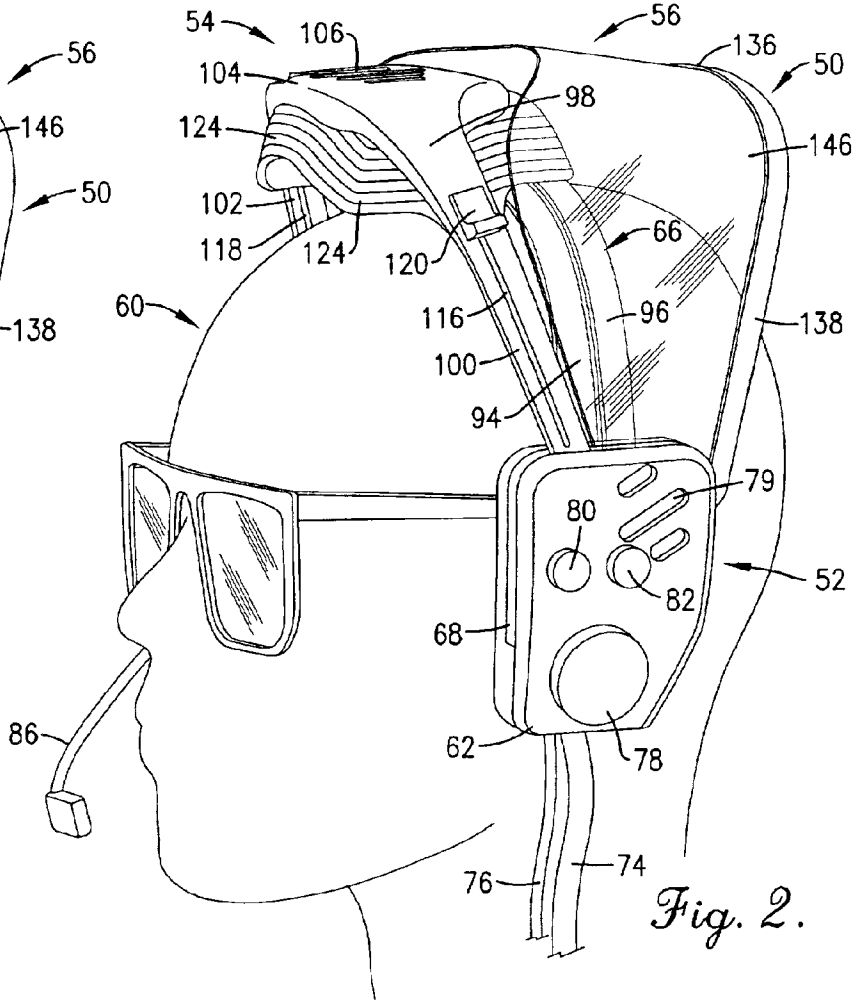
FIG. 2 is a perspective view illustrating the headset of FIG. 1 mounted on the head of a user.
Figure 1:
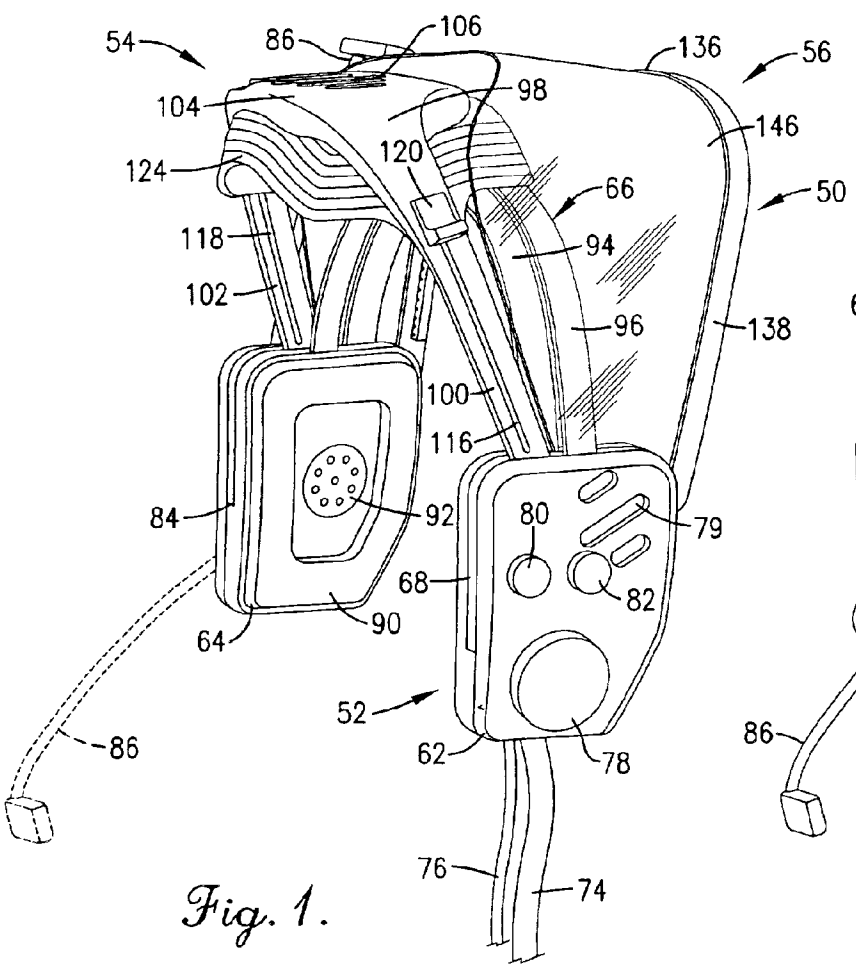
FIG. 1 is a perspective view of a headset in accordance with the invention, including individually deployable mask and visor units.
Figure 4:
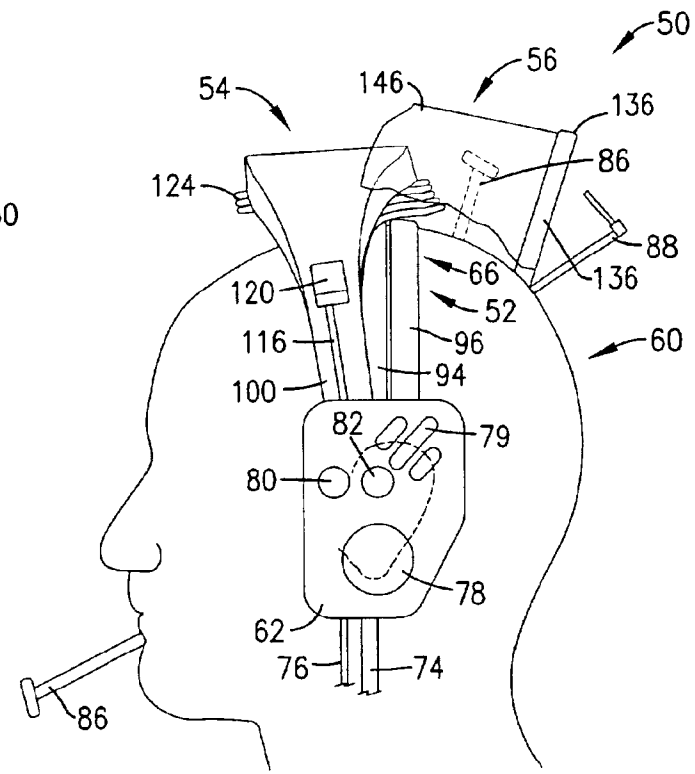
FIG. 4 is a fragmentary side view depicting the headset of FIG. 1 on the head of the user, with the mounting assembly in its initial, retracted position.
Figure 3:
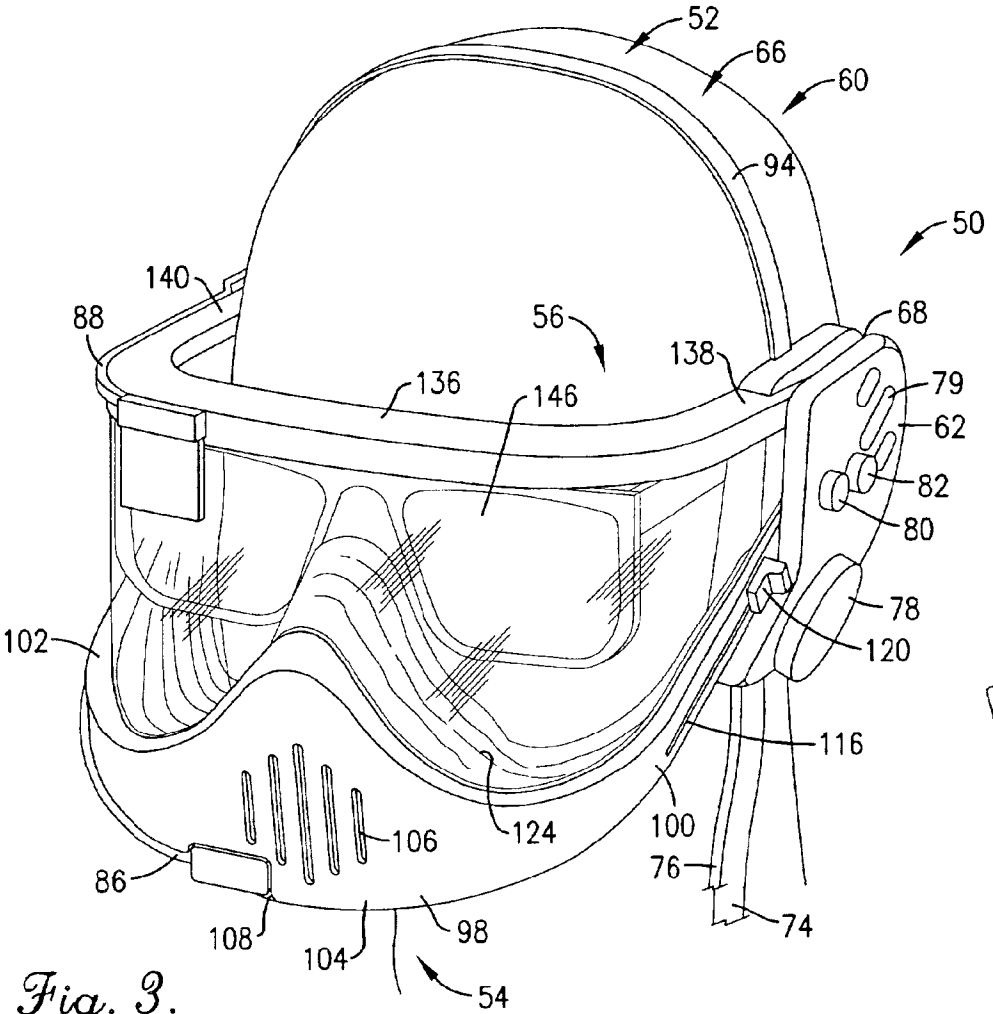
FIG. 3 is a front perspective view of the headset of FIG. 1, shown with the mask and visor units in their deployed condition.
Figure 20:
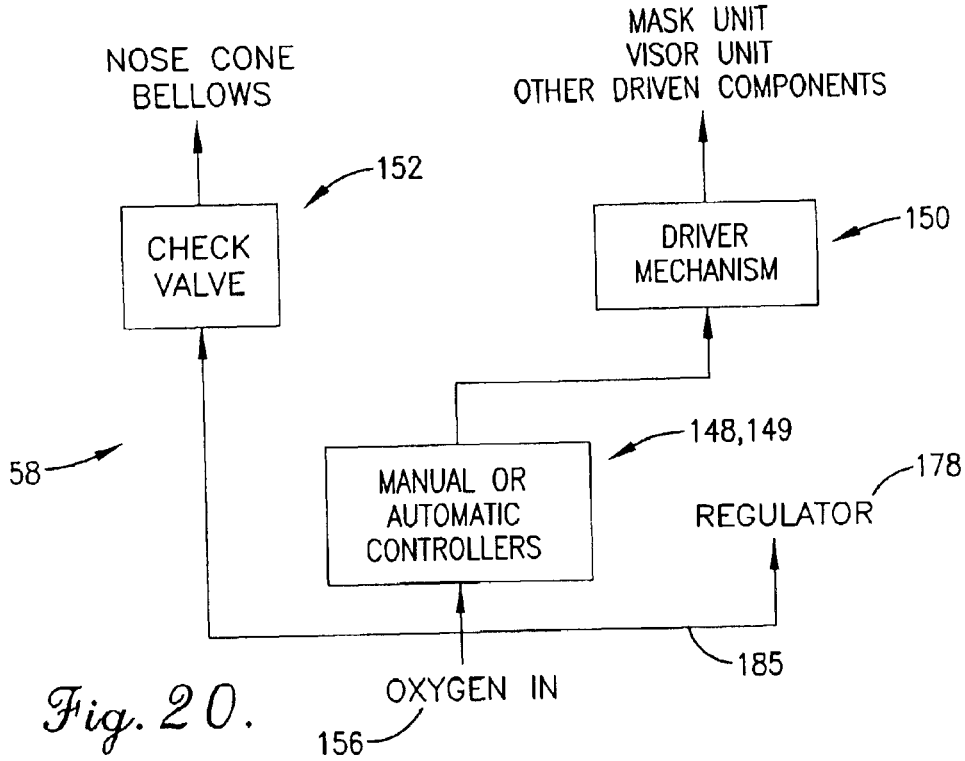
FIG. 20 is a schematic box diagram illustrating the interrelationship of the components of the preferred motive and control assembly forming a part of the headsets of the invention.
Figure 21:
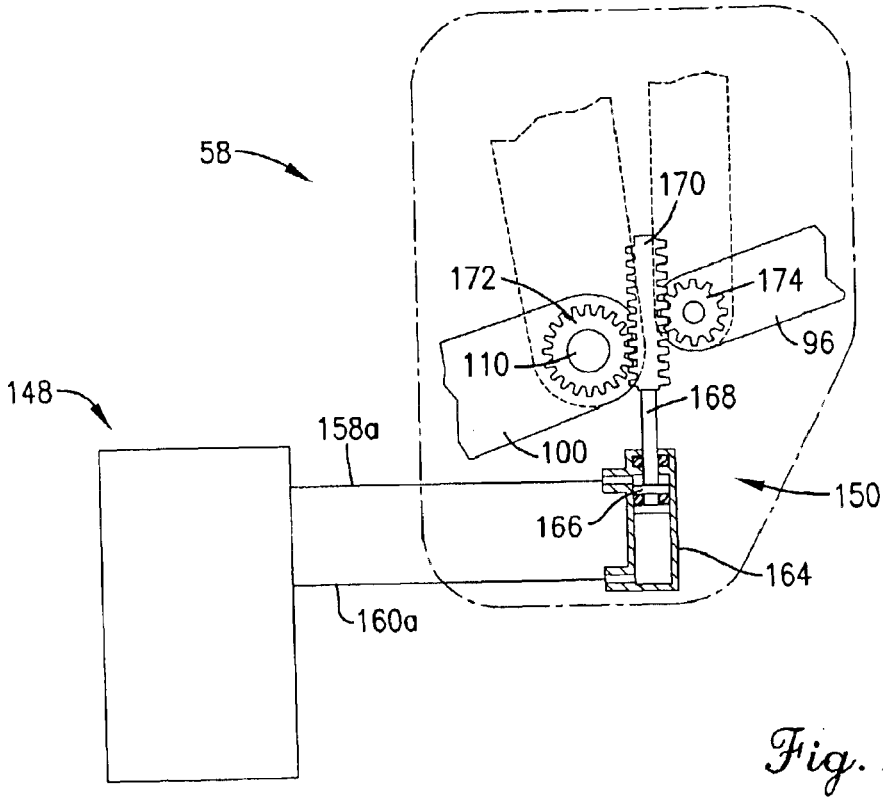
FIG. 21 is a fragmentary, partially schematic and partially sectional view of one form of drive mechanism used to deploy and retract the mounting assembly and mask.

Turning now to the drawings, a preferred headset 50 in accordance with the invention is illustrated in FIGS. 1–16, 20, 45 and 48. Broadly speaking, the headset 50 includes a head mounting assembly 52, a mask unit 54, visor unit 56, and a motive and control assembly 58 (see FIGS. 20–21). The headset 50 is designed to be worn by a user 60 so that the mask and visor units 54, 56 may be selectively maintained in a retracted position (see FIG. 2) or, in the event of an emergency situation, may be deployed (FIG. 3).

In more detail, the mounting assembly 52 includes a pair of opposed ear pieces 62, 64 oriented to cover the ears of user 60, together with an arcuate strap assembly 66 extending between the ear pieces 62, 64 and designed to extend over the crown of the user's head. The ear piece 62 includes an upper, open-ended slot 68 as well as fittings 70, 72 respectively for coupling of an oxygen line 74 and electrical lead 76 (see FIGS. 1–2). The exterior face of the ear piece 62 is equipped with a regulator selector knob 78 and regulator air entrance slots 79, as well as actuator buttons 80 and 82 for operation of the mask and visor units 54, 56, respectively. The opposed ear piece 64 is similar, having an upper, open-ended slot 84; this ear piece also pivotally supports a selectively deployable microphone 86 and a retinal scanning display device 88. The inner faces of each of the ear pieces 62, 64 is provided with circumscribing padding 90 and earphone 92. Such display devices and the use thereof in crew masks is fully described in co-pending and concurrently filed application entitled "Aviation Crew Mask with Retinal Scan Instrument Display for Smoke in Cockpit Emergencies", U.S. Pat. No. 6,657,220 issued May 20, 2003. The inner Laces of each of the ear pieces 62, 64 is provided with circuznscribing padding 90 ear phone 92.

The strap assembly 66 includes a stationary, arcuate strap 94 connected to and extending directly upwardly from the ear pieces 62, 64, so that the strap passes directly over the crown of the user's head. In addition, the assembly 66 has a movable strap 96 pivotally coupled to the ear pieces 62,64 and shiftable within the slots 68, 84 between a retracted or stowed position adjacent stationary strap 94 to a deployed position passing around the back of the user's head (see FIGS. 5–7). Selective movement of the strap 96 is effected during shifting of mask unit 54 as will be described below.

The mask unit 54 includes an arcuate, generally U-shaped rigid body 98 presenting a pair of side arms 100, 102 and a central bight section 104. The latter has a series of exhale slots 106, as well as a recess 108 for receiving the end of microphone 86. The inner end of each arm 100, 102 is located within a corresponding ear piece 62 or 64, i.e., the arms 100, 102 extend into the slots 68, 84 and are pivotally connected to the ear piece via pins 110 (see FIG. 16). The arm 100 is provided with a breathable gas passageway 112 terminating in an outlet 113, as well as a smaller mask inflation conduit 114 which extends to the area of bight section 104 and terminates in an inflation opening 115. Finally, both of the arms 100, 102 are provided with elongated slots 116, 118 which receive corresponding, manually operable slide lugs 120, 122 which are important for purposes to be made clear.

The overall mask unit further includes a flexible, resilient, inflatable, bellows-type mask body 124 which is mounted to the inner face of U-shaped rigid body 98, at the region of central bight section 104. To this end, the center of mask body 124 includes a projecting bead 126 which is received within a formed channel 128 in the inner face of U-shaped body 98. The outboard ends of the flexible mask body 124 are connected to the slide lugs 120, 122.

Figure 12:
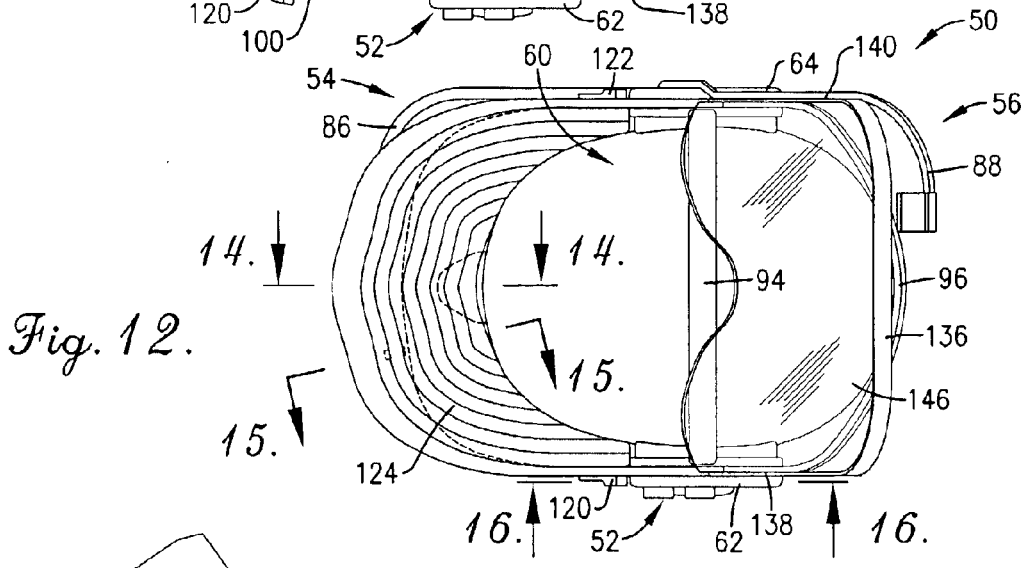
FIG. 12 is a view similar to that of FIG. 11, but showing the mask unit in its extended, face-sealing orientation.
Figure 13:
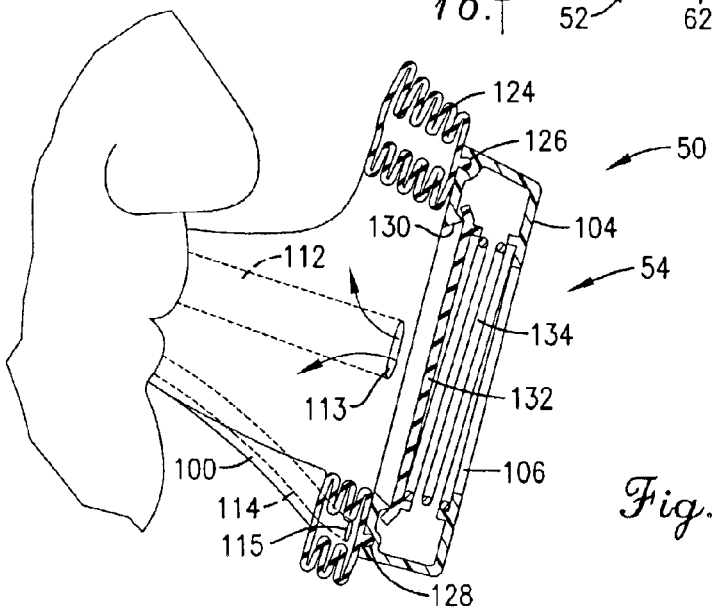
FIG. 13 is an enlarged, vertical sectional view taken along line 13—13 of FIG. 11 and illustrating in detail the configuration of the mask bellows and the flow paths for gas inflation of the bellows and delivery of breathable gas to the user.
Figure 14:
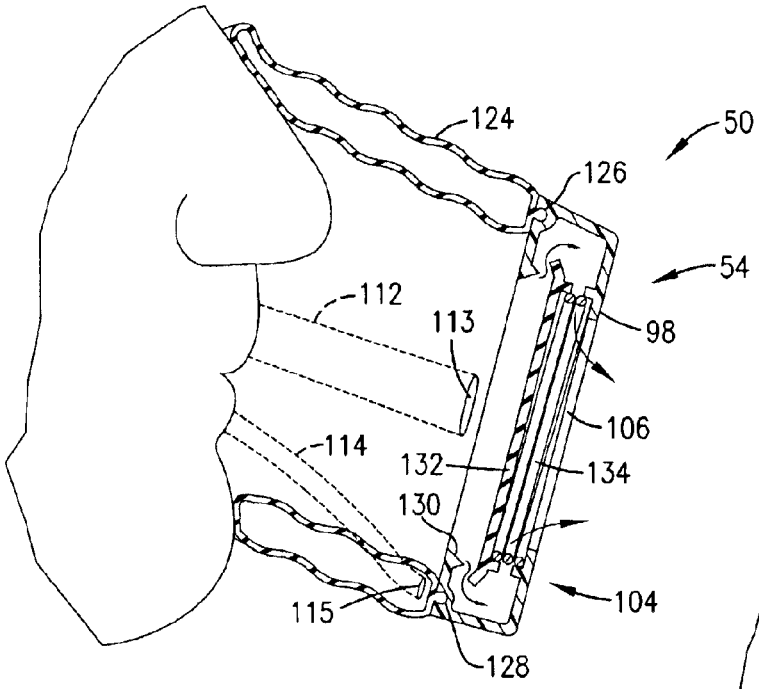
FIG. 14 is a vertical sectional view taken along line 14—14 of FIG. 12, depicting the bellows in the extended, face-sealing orientation thereof and also showing the operation of the mask during exhalation.
Figure 15:
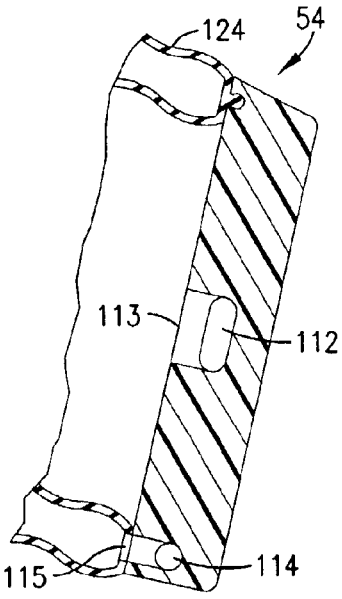
FIG. 15 is a vertical sectional view taken along line 15—15 of FIG. 12 and further depicting the configuration of the gas passageways for inflation and breathable gas.

The mask body 124 is configured so that it may be inflated for use. Specifically, in the retracted position of mask unit 54, the body 124 is not inflated (see, e.g., FIGS. 1 and 2). However, when the unit 54 is in its lowered, deployed position, the mask body 124 is inflated by passage of pressurized gas through conduit 114. This action serves to inflate the mask as shown in FIG. 14 so that the inboard surfaces thereof contact the user's face and cover the nose and mouth area. Inflation of the mask 124 in this fashion causes the ends of the mask coupled with slide lugs 120, 122 to move along the length of the arms 100, 102, until the inflated mask extends around and covers the nose and mouth area and face areas on opposite sides thereof as illustrated in FIG. 12. In the event that the user wishes to manually extend the mask body 124, or a hangup occurs, the slide lugs 120, 122 may be manually shifted rearwardly along the respective slots 116, 118 so that the mask body 124 will assume the FIG. 12 position.

As is conventional with many mask units, the unit 54 includes a central exhale opening 130 formed in the rearward face of bight section 104, in opposition to the exhale slots 106. The opening 130 is normally closed by a diaphragm 132, the latter biased towards the closed position by means of spring 134.

The visor unit 56 also includes a somewhat U-shaped main body 136 having elongated side arms 138, 140 which are likewise received within ear piece slots 68, 84; the inboard ends of the arms 138, 140 are similarly pivotally supported within the ear piece slots. The body 136 may alternately be equipped with an internal conduit 142 as well as a series of laterally spaced apart gas outlet passageways 144 along the inner face thereof (see FIG. 8). The visor unit also includes a "wrap around" transparent synthetic resin lens 146 which is supported and depends from body 136. It will be observed that the lower end of the lens 146 is complemental with the upper surface of U-shaped mask body 98.

The motive and control assembly 58 is housed within ear piece 62 and is designed to effect manual or automatic phased deployment of the mask unit 54 (together with strap assembly 66) and visor unit 56. That is, depending upon ambient conditions, the mask unit 54 may be deployed along with assembly 66; however, if smoke conditions are encountered, the visor unit 56 may also be deployed.

In particular, the motive and control assembly 58 broadly includes mask and visor controllers 148, 149, separate drivers 150 for the mask and visor units 54, 56 respectively, and a gas delivery assembly 152. Referring to FIGS. 45 and 48, it will be seen that the controllers 148, 149 are substantially identical and each include a pneumatic valve 154 coupled to pressurized oxygen source 156 via input lines 158, 160, as well as output lines 158*a*, 160*a*, and exhaust line 161. The valves 154 are shiftable by depression of actuator buttons 80 or 82, and also may be automatically operated through operation of a pressure-responsive aneroid 162 in the case of controller 148, and a solenoid/smoke detector 163 in the case of controller 149. As will be seen, operation of the valve serves to direct pressurized gas to the mask or visor drive mechanism for up or down operation thereof with corresponding exhaust in each case. Now referring to FIG. 21, it will be seen that the output lines 158*a*, 160*a* are coupled to the driver 150 for mask unit 54. An identical operator 150 (not shown) is also provided for operation of the visor unit 56. In this instance, the drive mechanism 150 includes a double acting pneumatic piston and cylinder assembly 164 having an internal piston 166 and an outwardly projecting piston rod 168 equipped with rack 170. The overall drive mechanism includes a pair of gears 172, 174 which are respectively coupled to arm 100 of U-shaped mask body 98 and to movable mounting strap 96; these gears are in mesh with rack 170 as shown.

Figure 5:
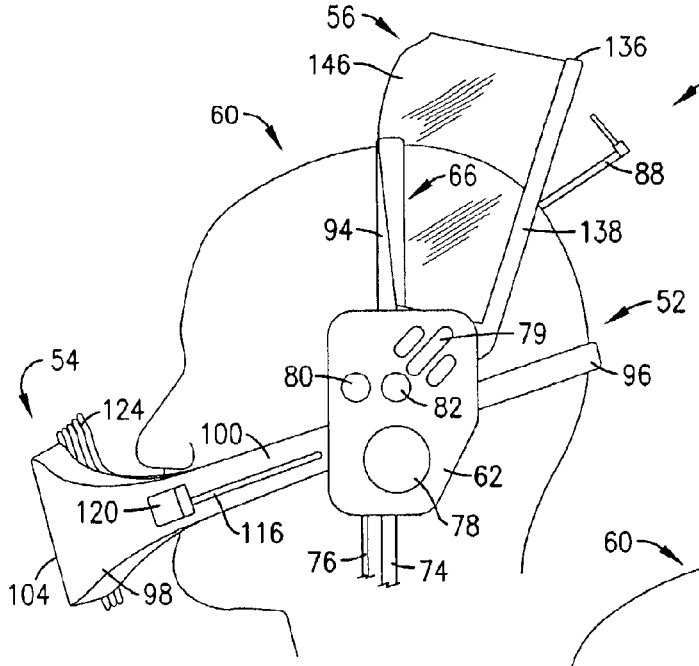
FIG. 5 is a view similar to that of FIG. 4, but showing the mounting assembly fully deployed and with the mask unit in its lowered position prior to fitting of the mask about the nose and mouth region of the user.
Figure 6:
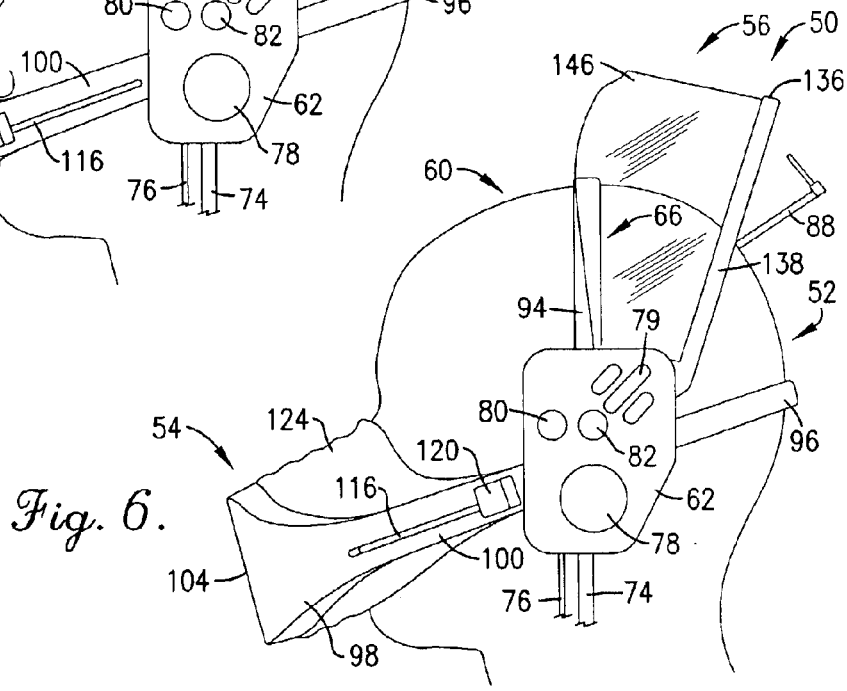
FIG. 6 is a side view similar to that of FIG. 5, but showing the mask unit fully deployed and in sealing engagement with the face of the user.
Figure 7:
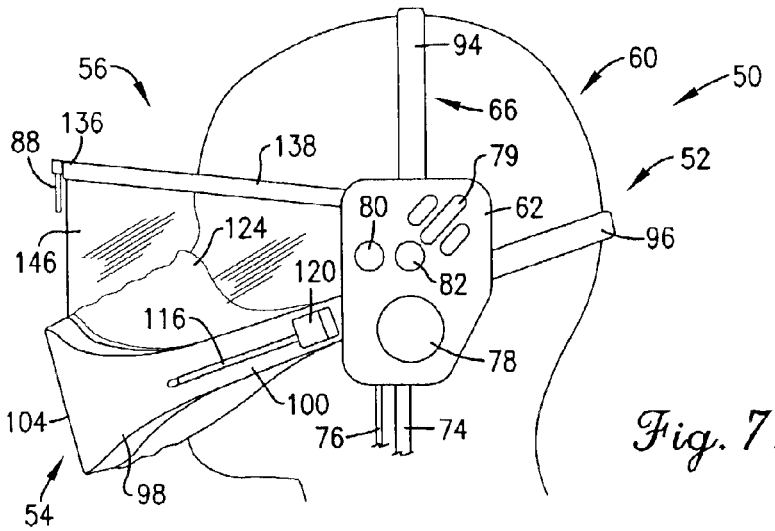
FIG. 7 is a side view similar to that of FIG. 6, but showing the complemental visor unit in its lowered, fully deployed position atop the mask unit.

It will thus be appreciated that upon movement of piston 166 as dictated by passage of pressurized gas through line 160 and exhaust through line 161, the rod 168 is extended, thereby causing the gears 172, 174 to rotate to simultaneously move the mask unit 54 and strap 96 to their deployed positions illustrated in FIG. 5 for example. A similar rack and gear drive mechanism is employed for the selective movement of visor unit 56 between the retracted and deployed positions thereof.

Figure 16:
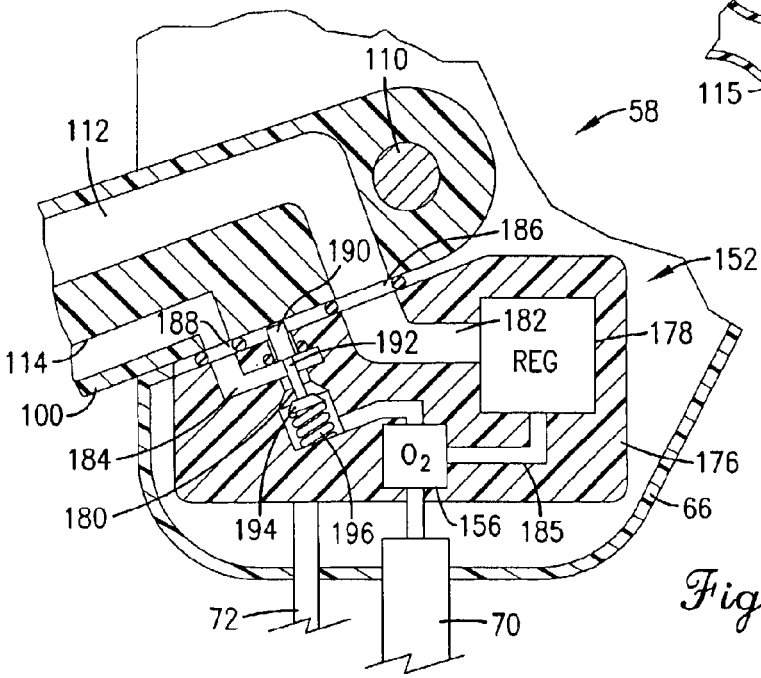
FIG. 16 is a vertical sectional view taken along line 16—16 of FIG. 12, showing the configuration of the pneumatic portion of the motive and control assembly for the headset of FIG. 1.

The gas delivery assembly 152 is likewise housed within ear piece 62 and includes a block 176 including the pressurized oxygen source 156 in the form of a reservoir, regulator 178, valve 180 passageways 182, 184, 185 and outlets 186, 188. Referring to FIG. 16, it will be observed that the passageway 185 extends between the source 156 and regulator 178, whereas the passageway 182 extends from the output of the regulator to outlet 186. The passageway 184 extends from source 156 through the valve 180 and terminates at outlet 188. The valve 180 includes an outwardly projecting arm 190 received within opening 192 and a base 194. A coil spring 196 serves to urge the valve outwardly as shown in FIG. 16.

When the arm 100 is in its lowered position, i.e., when the mask unit 54 is moved to its deployed location, the breathable gas passageway 112 of the arm comes into communication with outlet 186. Similarly, the inflation conduit 114 comes into communication with outlet 188. Finally, movement of the arm 100 depresses valve arm 190 against the bias of spring 196 so that the valve opens as illustrated in FIG. 16. This allows pressurized oxygen to pass through the inflation conduit 114 and outlet 115 so as to inflate the flexible mask body 124. Also, an appropriate breathable gas (e.g., either pure oxygen or a mixture of air and oxygen as dictated by the position of selector knob 78) is deliverable via passageway 112 to mask outlet 113.

Figure 8:
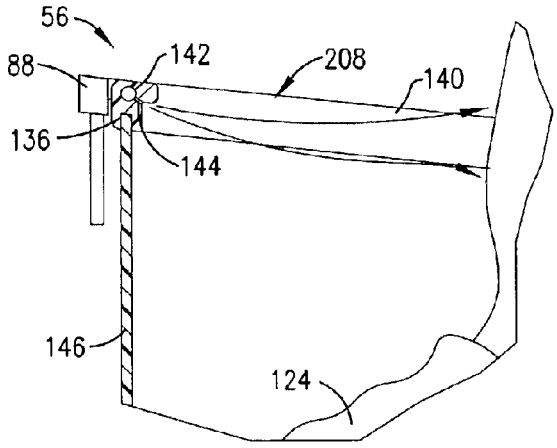
FIG. 8 is a greatly enlarged, fragmentary view depicting the use of an air current for inhibiting the entrance of smoke into the visor unit upon deployment thereof.
Figure 9:
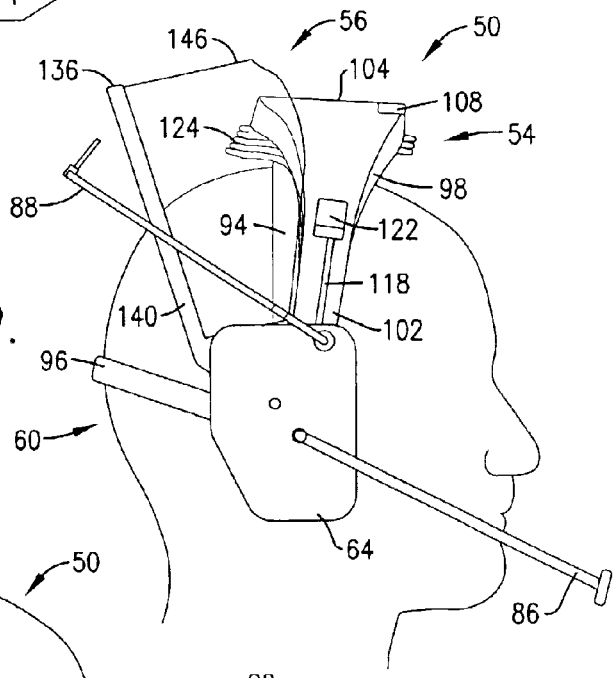
FIG. 9 is a side view similar to that of FIG. 5, but showing the opposite side of the headset.
Figure 10:
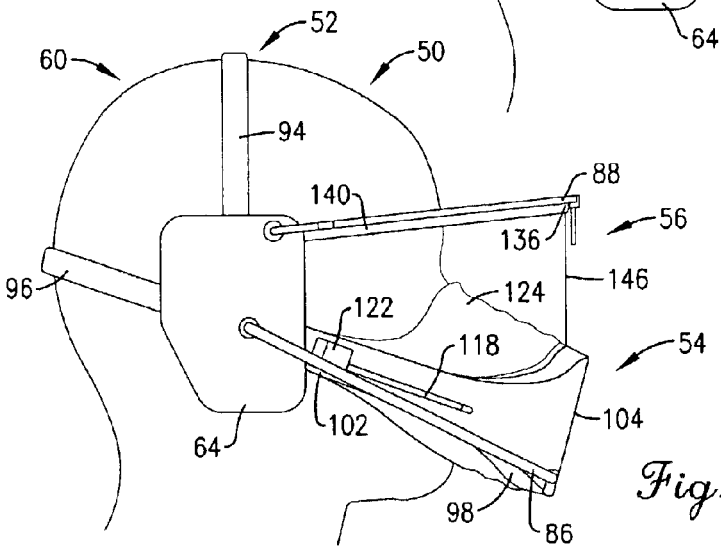
FIG. 10 is a side view similar to that of FIG. 7, but showing the opposite side of the headset with the mask and visor units in their lowered, deployed positions.
Figure 27:
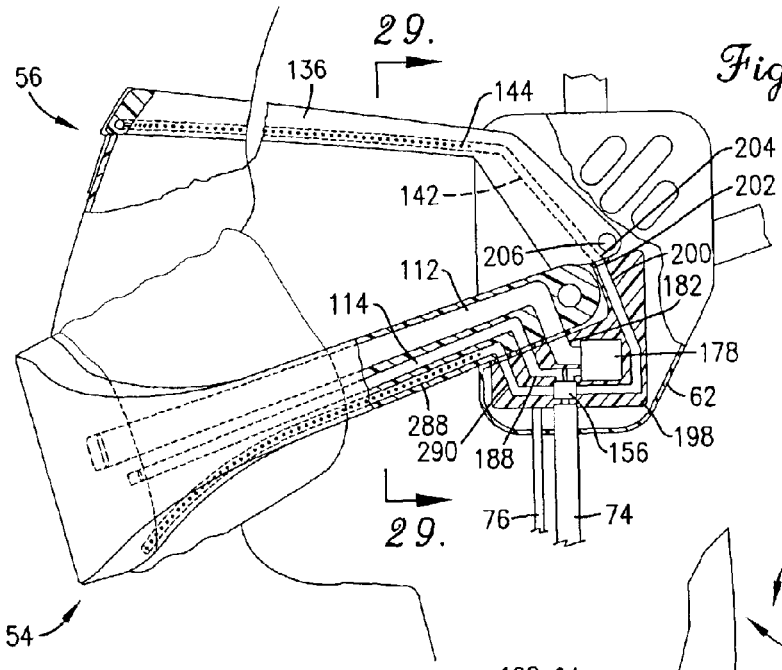
FIG. 27 is a fragmentary, vertical sectional view of the FIG. 1 headset in its fully deployed condition, and illustrating the mask inflation and breathable gas passageways, as well as the use of air curtain assemblies for inhibiting entrance of smoke into the headset.

In the event that the visor design of FIG. 8 is employed, i.e., with air outlet openings 144 along the inner surface of the visor body 136, the ear piece 62 would include a block 198 as illustrated in FIG. 27. The block 198 includes all of the components of block 176 previously described (and such common components are identified by identical reference numerals), as well as a conduit 200 extending from source 156 and terminating in an outlet opening 202. The visor body conduit 142 extends along the length of body 136 in communication with the outlet passageways 144 and presents an inlet opening 204. When the visor is lowered, the openings 202,204 come into communication for passage of pressurized oxygen to the visor. Although not shown in FIG. 27, the conduit 200 may be valve-controlled via a valve 180 as in the case of conduit 188 of FIG. 16.

The operation of this embodiment proceeds as follows. First, the user dons the headset as shown in FIG. 2, with the assembly 52, mask unit 54 and visor unit 56 in their retracted positions over the crown of the user's head. The microphone 86 may be deployed as shown for communication purposes.

Figure 11:
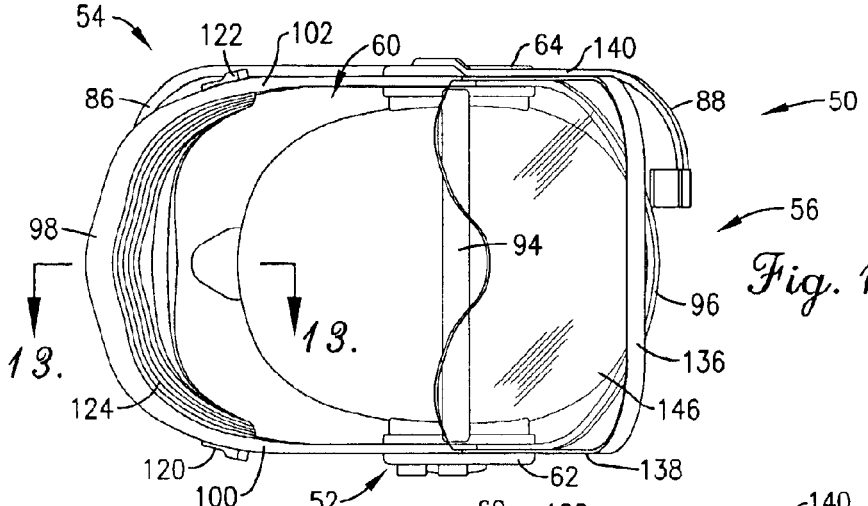
FIG. 11 is a plan view of the FIG. 1 headset, with the mask unit lowered but not fully deployed as depicted in FIG. 5.

In the event of a flight deck emergency, the mask unit 54 and strap assembly 66 are deployed. This can be automatic in the case of a depressurization, which would be sensed by aneroid 162. Alternately, if the user perceives an emergency situation, the actuator button 82 may be depressed to achieve this result. In either case, the U-shaped mask body 98 carrying the flexible mask 124 is shifted downwardly until the position of FIG. 5 or FIG. 11 is reached. This involves actuation of valve 154 so as to direct pressurized oxygen from source 156 to output line 160*a*. This in turn serves to move piston 166 and rod 168, so that the intermeshed gears 172, 174 rotate, thereby shifting the body 98 downwardly and also moving the shiftable strap 96 to the deployed position thereof shown in FIGS. 9–10. As the arm 100 moves downwardly, it encounters the upper end of valve arm 190, moving it against the bias of spring 196 to open the valve. This establishes flow communication with the inflation conduit 114, which thereby initiates inflation of the mask body 124. This continues until the mask assumes the FIG. 14 position, with the outer portions of the mask part body in engagement with the face of user 60. In the event that the inflation of the mask body 124 is obstructed or otherwise hangs up, the user may manually grasp the slide lugs 120, 122 to pull these rearwardly and thus complete the deployment of the mask 124.

Breathable gas flowing through the passageway 112 enters the inflated mask through opening 113 to provide breathable gas to the user. In this connection, flow of breathable gas can be continuous or on a demand basis, at the discretion of the designer. During exhalation (FIG. 14), the diaphragm 132 is shifted allowing exhale gas to pass through opening 130 and out the exhale slots 106.

If the emergency condition requires use of visor unit 56, the actuator button 82 may be depressed or automatic operation of valve 154 can be effected through the solenoid/smoke detector 163. In either case, a visor driver 150 is actuated to lower the entire visor unit; specifically, pressurized oxygen is directed through line 160*a* of the visor controller valve so as to shift the piston 166 of the visor driver mechanism, thereby causing the visor unit to pivot downwardly to the position shown in FIG. 10. As indicated previously, the visor body 136 is pivotally coupled to both of the ear pieces 62, 64 by means of pivot pins 206 (FIG. 27).

If the FIG. 8 embodiment is employed, making use of the associated block 198 and gas passageways 144, pressurized oxygen is delivered through conduit 200 to conduit 142, with the result that generally horizontally directed airstreams 208 are created which extend towards and impinge upon the forehead of the user. A relatively low pressure stream of such gas effectively prevents the ingress of smoke into the visor unit 56.

When the emergency condition is passed, the user may reverse the operation of the mask and visor units 54, 56, so that the latter reassume their retracted positions. First, actuator button 82 is engaged to cause the visor control valve 154 to shift (160*a* to 160 and 158*a* to 158), which reverses the movement of piston 166 of the visor driver mechanism 150, so that the visor unit is pivoted upwardly to the retracted position thereof. Next, the button 80 is pushed, causing the mask body to deflate and reassume the collapsed condition thereof, and unit driver mechanism 150 is actuated to reverse the movement of both the mask unit 54 and the strap assembly 66 of head mounting assembly 52.

Figure 17:
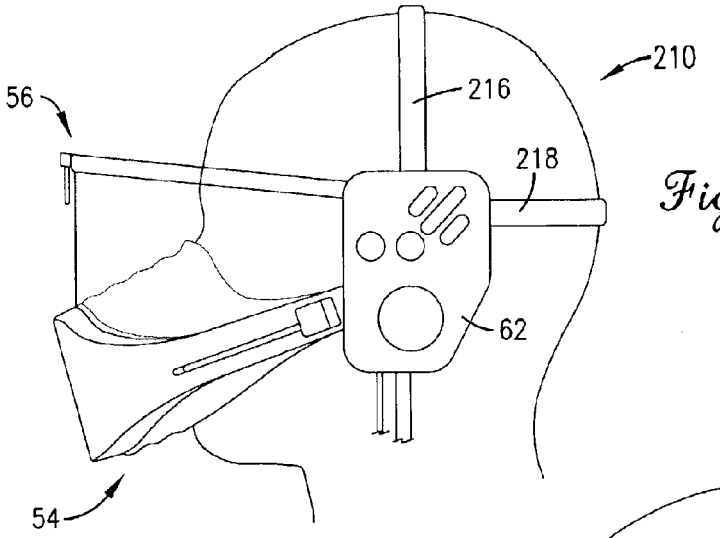
FIG. 17 is a side view of another headset in accordance with the invention shown with the mask and visor units deployed and including a mounting assembly including stationary, orthogonal head straps.

The principles of the invention may be used in a variety of different type of mask and visor unit headsets. For example, attention is directed to FIGS. 17–19 which illustrate exemplary types of head mounting assemblies 210, 212, 214. In all other particulars, the depicted headsets correspond to that described above. In FIG. 17, the head mounting assembly 210 includes a pair of substantially orthogonal stationary straps 216, 218 which are fixedly secured to the ear pieces. It is contemplated that such straps may be adjustable for different head sizes, but would otherwise be stationary.

Figure 18:
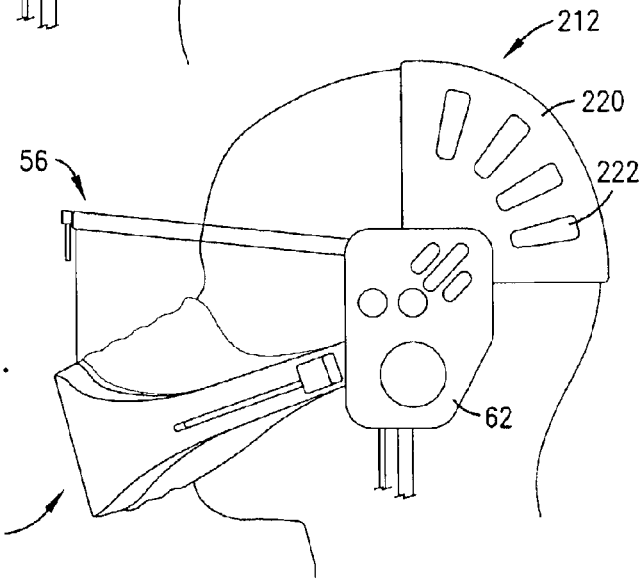
FIG. 18 is a side view of another headset in accordance with the invention shown with the mask and visor units deployed and including a mounting assembly including a stationary skull cap member.
Figure 19:
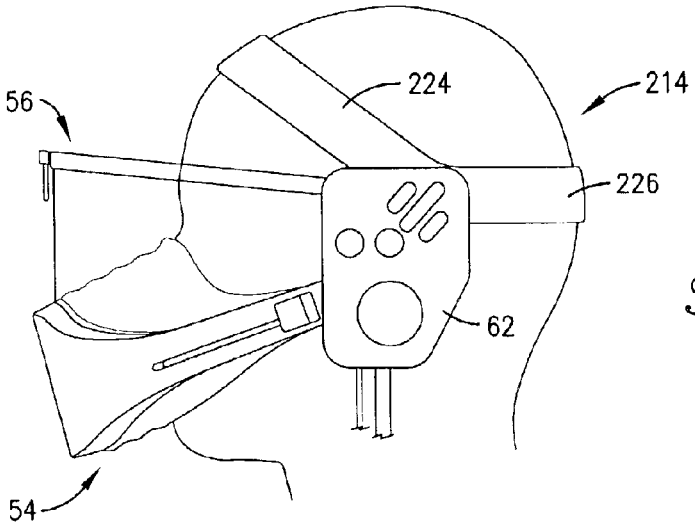
FIG. 19 is a side view of another headset in accordance with the invention shown with the mask and visor units deployed and including a mounting assembly including stationary head straps of "halo" configuration.

In FIG. 18, a skull cap 220 is employed as a part of the assembly 212. Here again, the cap 220 is stationary and is secured to the ear pieces. As shown, the cap may be vented as at 222 for comfort purposes. In FIG. 19, the assembly 214 includes a pair of stationary straps 224, 226. The latter passes around the rear of the head of the user whereas strap 224 extends upwardly and obliquely relative to the strap 226 to define a "halo" type of mounting assembly. Here again, the straps 222, 224 are secured to the ear pieces and are stationary.

Figure 23:
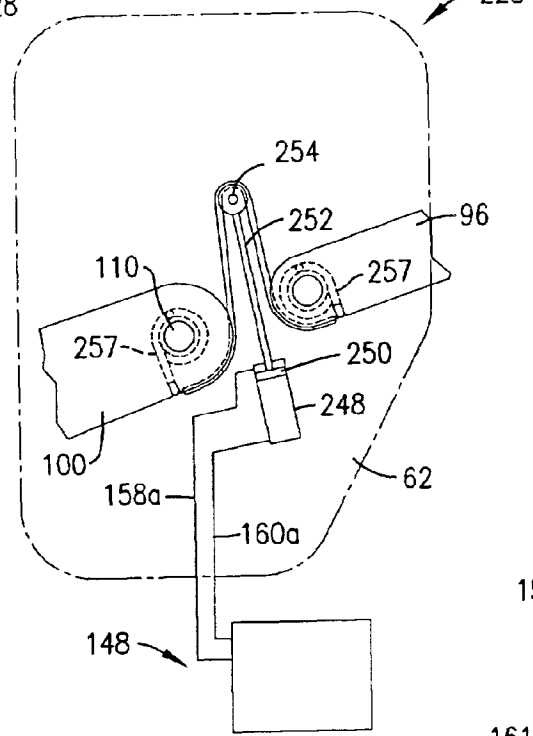
FIG. 23 is a view similar to that of FIG. 22, but showing the drive assembly in its extended position upon deployment of the mounting assembly and mask unit.
Figure 22:
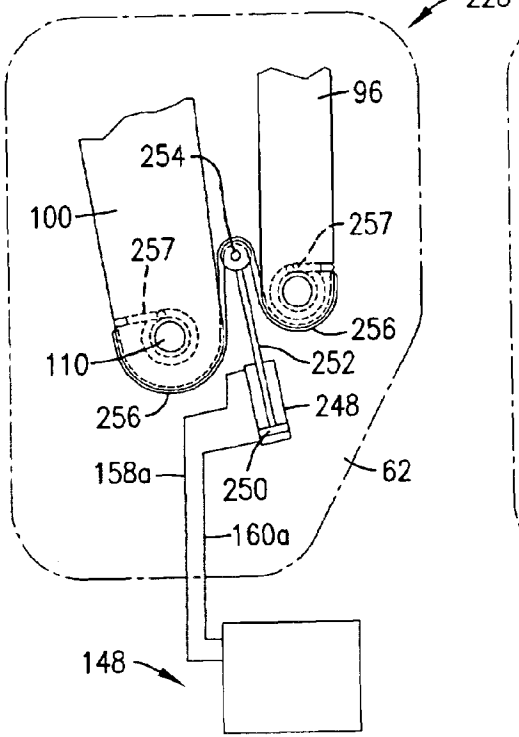
FIG. 22 is a fragmentary, partially schematic and partially sectional view of another form of drive mechanism used to deploy and retract the mounting assembly and mask.

FIGS. 22–26 depict other types of motive and control assemblies 228, 230, 232. In FIGS. 22 and 23, the assembly 228 includes previously described controller 148 as well as a drive assembly 236. The drive assembly 236 includes a piston and cylinder assembly 246 including cylinder 248, piston 250 and outwardly extending piston rod 252. The rod 252 is equipped with an outermost grooved annular head 254. An elongated tie element 256 is secured to the inner pivoted ends of the arm 100 and strap 96 as shown. In each instance, the tie end is secured about the associated pivot connection, such as pivot pin 110 by way of torsion springs 257. It will further be seen that the head 254 engages the tie element 256 intermediate the ends thereof, i.e., between the arm 100 and strap 96. FIG. 22 illustrates the apparatus in the retracted position, that is, where the mask unit is in its upper position. FIG. 23 on the other hand depicts the configuration of the control assembly 228 upon deployment of the mask. That is, the controller 148 is operated either automatically or manually in order to send pressurized oxygen to cylinder 248, thereby shifting piston 250 and rod 252 upwardly; such movement extends the tie element 256, causing the arm 100 and strap 96 to be shifted downwardly. When it is desired to move the mask unit and strap 96 back to their retracted positions, the pressure within cylinder 248 is exhausted by appropriate manipulation of valve 238. As this point, the torsion springs 257 serve to retract the mask unit and strap 96.

Figure 24:
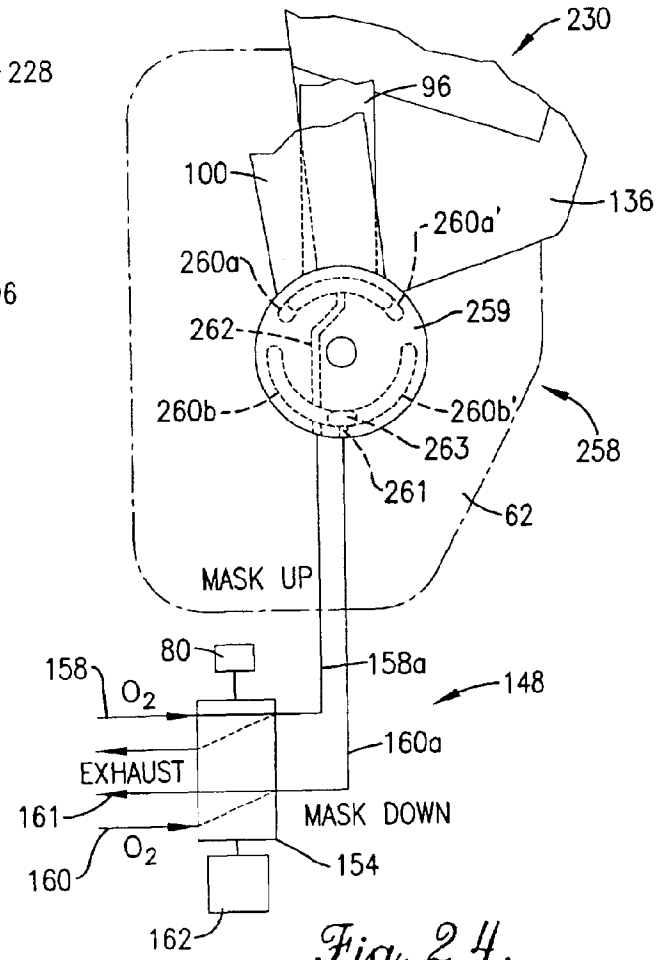
FIG. 24 is a fragmentary, partially schematic and partially sectional view of another form of drive mechanism used to deploy and retract the mounting assembly and mask and/or visor units of the headsets of the invention.
Figure 25:
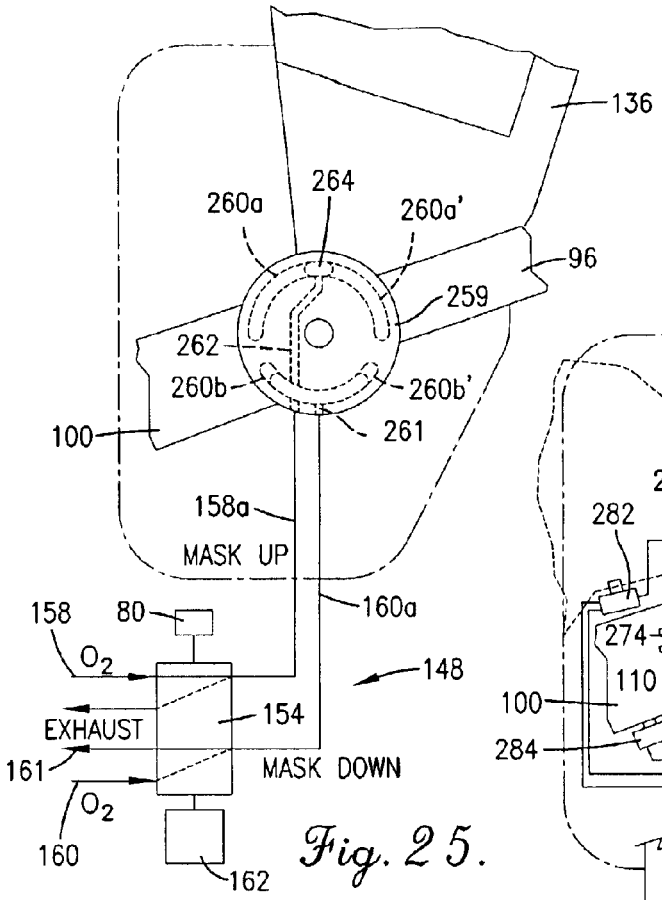
FIG. 25 is a view similar to that of FIG. 24, but showing the drive assembly in its extended position upon deployment of the mounting assembly and mask unit.

FIGS. 24 and 25 illustrate an alternative motive and control assembly 230 which includes a controller 148 (see FIG. 45) and a drive assembly 258 comprising four coaxial, rotatable disks 259. The outboard disk 259 supports the arm 100, the next adjacent inner disk supports strap 96. The next disk is simply an operator, whereas the innermost disk supports the main body 136 of visor unit 56. Each disk 259 includes an upper and a lower arcuate slot 260*a*, 260*b* which are in mated alignment with the slots 260*a*' and 260*b*' of the adjacent disk as shown in FIGS. 24 and 25 (depicting the outermost and next adjacent disk 259 for movement of the mask unit 54 and strap 96 of strap assembly 66). A short passageway 261 extends from the base of the mated disk pair to the corresponding lower arcuate openings 260*b* and 260*b*'. Similarly, a passageway 262 extends from this base to the upper arcuate openings 260*a*, 260*a*'. The "mask up" output line 158*a* from controller 148 is coupled with passageway 262, whereas mask down output line 160*a* is connected with passageway 261. Although not shown in detail, it will be understood that the third and innermost disks 259 are configured in the same manner as the disks shown in FIG. 24 and 25, and are coupled with a valve controller 149 (FIG. 48).

In FIG. 24, the headset is shown with the mask and visor units in their upper, retracted positions. In the event of a flight deck emergency, either by actuation of button 80 or via automatic control through aneroid 162, the valve 154 is shifted so that pressurized oxygen is directed to output line 160*a*. This causes the pressurized oxygen to enter the small chamber 263 formed between the adjacent ends of the lower arcuate slots 260*b*, thereby rotating the disks in opposite rotational directions until the disks assume the FIG. 25 position. In this position, the arm 100 is lowered along with strap 96. A further consequence of this movement is the formation of another small chamber 264 between the adjacent ends of the upper mating arcuate slots 260*a*. When it is desired to retract the mask unit 54, it is only necessary to manipulate button 80 to shift valve 154 so that pressurized oxygen is delivered to line 158*a* and passageway 262 for delivery to chamber 264. This in turn causes reverse relative rotation of the adjacent disks 259, so that the strap 96 and arm 100 are returned to their FIG. 24 retracted position. Of course, the operation of visor unit 56 is identical, in that the valve 154 of controller 149 is manipulated to alternately deliver pressurized oxygen to the output lines 160*a* or 158*a* for visor down and visor up operation.

Figure 26:
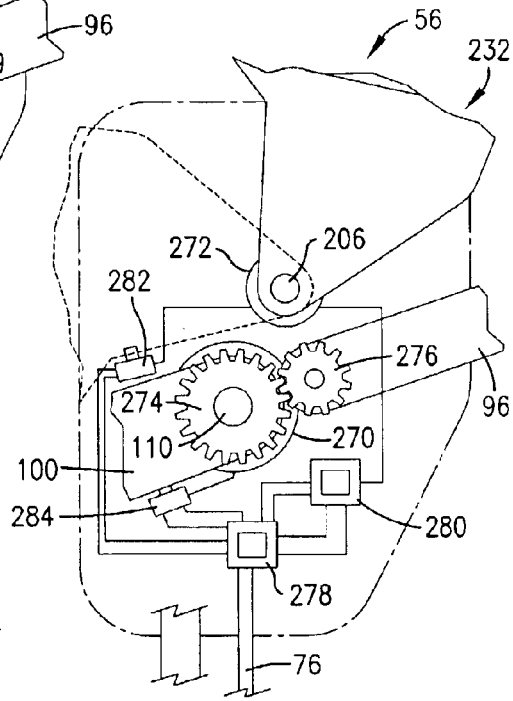
FIG. 26 is a fragmentary, partially schematic view of another form of drive mechanism used to deploy and retract the mounting assembly and mask and/or visor units of the headsets of the invention.

FIG. 26 depicts a still further motive and control assembly 232. In this case, the assembly 232 includes stepper motors 270,272 respectively mounted on the pivot pins 110,206 associated with the mask unit 54 and visor unit 56, respectively. Additionally, the assembly 232 includes a pair of intermeshed gears 274, 276 coupled to pin 110 and the pivot mount for movable strap 96. The electrical lead 76 is connected to oxygen mask switch 278 which is in turn operably coupled with visor switch 280, as well as two limit switches 282, 284. The switches 278, 280 are also operably coupled with the corresponding stepper motors 270, 272.

In operation, when the switches 278 and/or 280 are actuated (either manually via the buttons 80, 82 or automatically through an aneroid or similar controller), an appropriate electrical signal is sent to the stepper motor 270, which causes arm 100 to pivot down and also, via the gears 274, 276, effects downward movement of the strap 96. Up and down movement of the arm 100 is controlled by means of the limit switches previously described. In the case of visor unit 56, closing of switch 280 causes actuation of stepper motor 272, so that the visor unit is moved to its deployed condition. Of course, the stepper motors 270,272 may be reversed by appropriate manipulation of the switches 278, 280, to selectively retract the visor unit 56 and mask unit 54.

Figure 28:
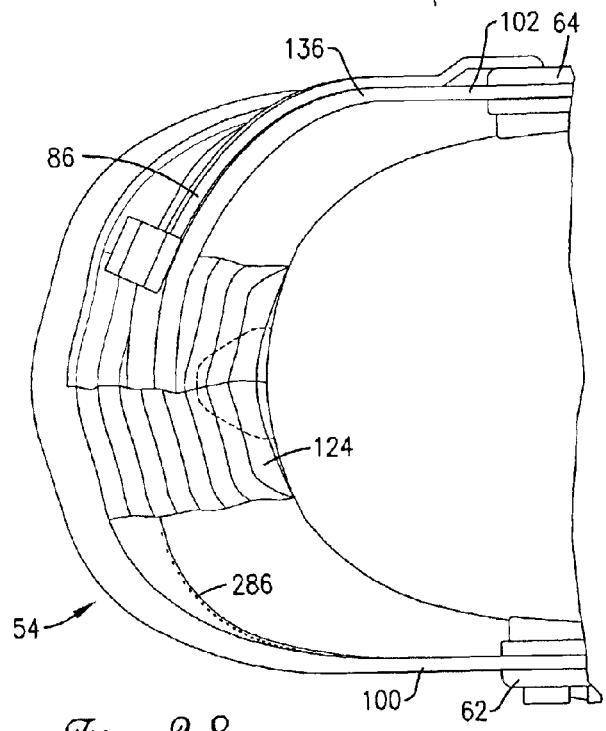
FIG. 28 is a fragmentary top view of the headset illustrated in FIG. 27.
Figure 29:
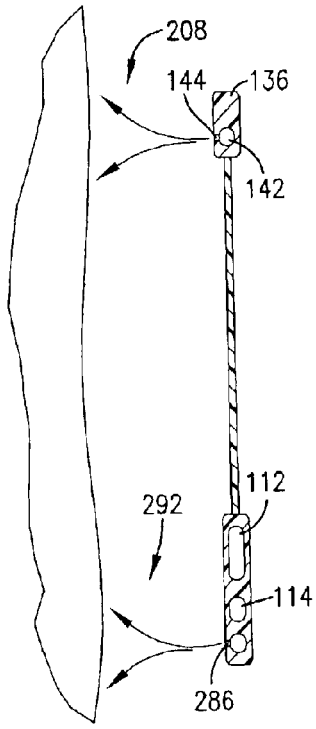
FIG. 29 is a vertical sectional view taken along line 29—29 of FIG. 27 and showing the operation of the air curtain assemblies.
Figure 34:
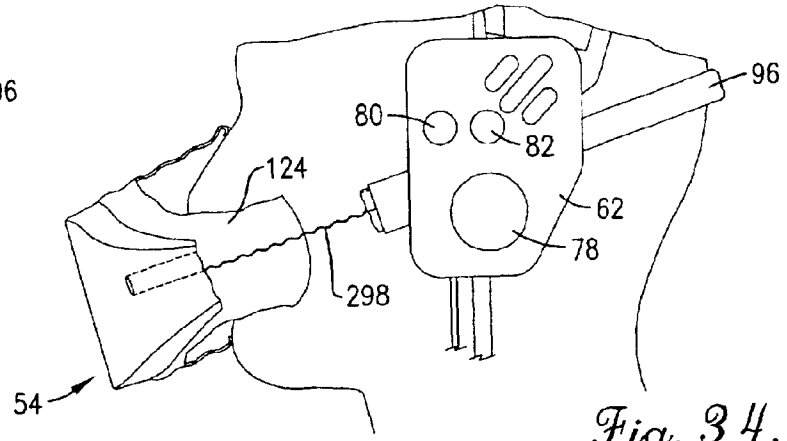
FIG. 34 is a view similar to that of FIG. 32, but showing the curtain mechanism in its deployed, face-engaging position.

FIGS. 27–29 depict a further modified embodiment in accordance with the invention. In this instance, the mask unit 54 is equipped with a series of lower, inwardly directed air passageways 286 similar to the visor passageways 144 previously described (see FIG. 8). Additionally, the mask unit has an elongated conduit 288 in communication with the passageways 286. As illustrated in FIG. 27, when the mask unit 54 is in its lowered, deployed condition, the conduit 288 comes into communication with a similar conduit 290 formed in block 198, the latter being operatively coupled with pressurized oxygen source 156. Thus, as best seen in FIG. 29, when the mask and visor units are in their lower, deployed condition, upper and lower air currents 208 and 292 are directed from the passageways 144,286, thereby preventing ingress of smoke into the mask and visor units. It will be observed (FIG. 28) that in this embodiment, the mask 124 need only cover the nose and mouth region of the user, there being no need for the extensible side margins of the embodiment depicted for example in FIG. 12 for the purpose of preventing ingress of smoke into the device.

Figure 30:
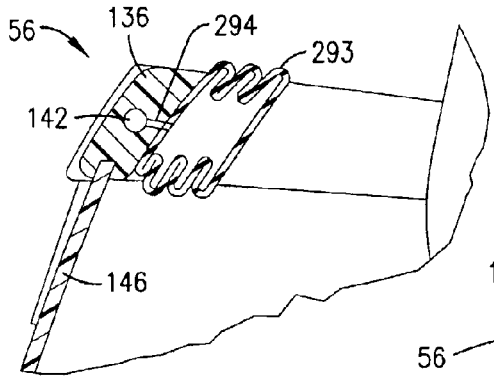
FIG. 30 is an enlarged, fragmentary vertical sectional view of a modified visor unit in accordance with the invention, making use of an inflatable bellows for face-sealing purposes.
Figure 31:
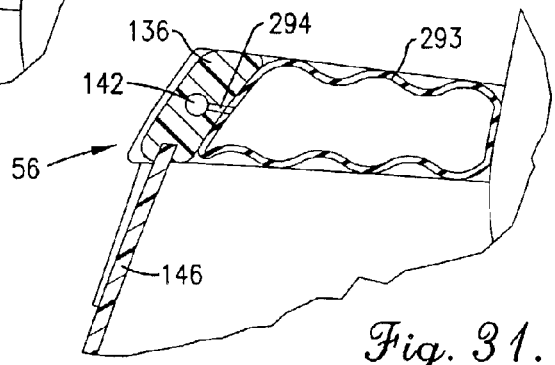
FIG. 31 is a view similar to that of FIG. 30, but illustrating the bellows in its inflated condition.

FIGS. 30 and 31 illustrate another mechanism used to prevent smoke ingress into the visor unit 56. In this instance, an expandable, elongated bellows 293 is provided, mounted to the inner face of body 136 and in communication with conduit 142 via opening 294. As shown in FIG. 31, upon inflation of the bellows 293, the inner surface thereof comes into engagement with the forehead of the user thereby preventing smoke ingress.

Figure 35:
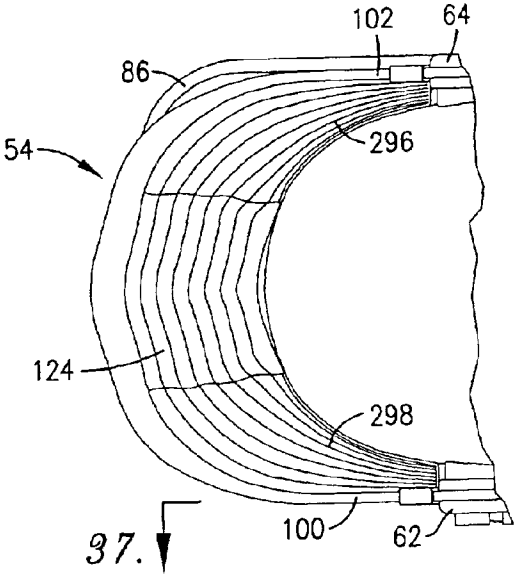
FIG. 35 is a fragmentary top view of the apparatus illustrated in FIG. 34.
Figure 32:
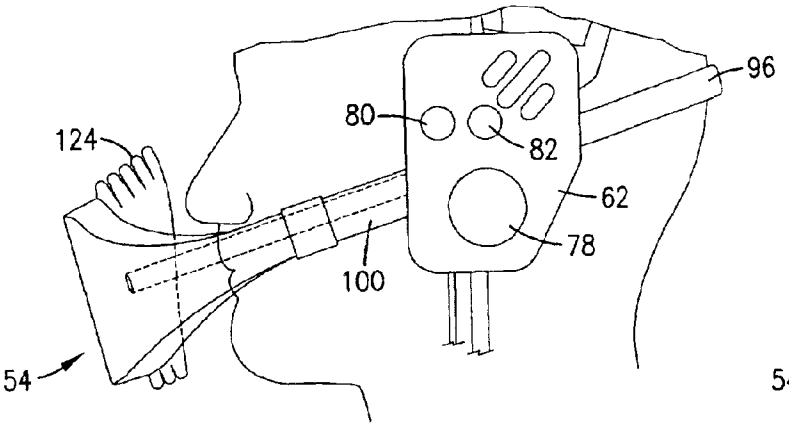
FIG. 32 is a fragmentary side view of another headset design in accordance with the invention, including a manual slider curtain mechanism allowing manual deployment of the mask unit against the face of the user.
Figure 33:
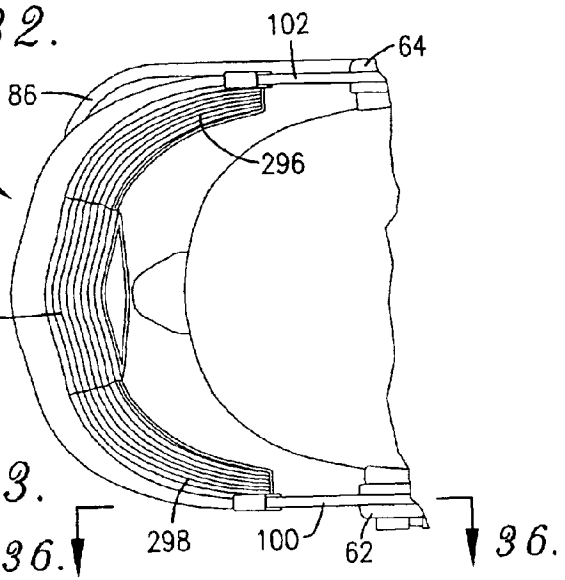
FIG. 33 is a fragmentary top view of the apparatus illustrated in FIG. 32.
Figure 36:
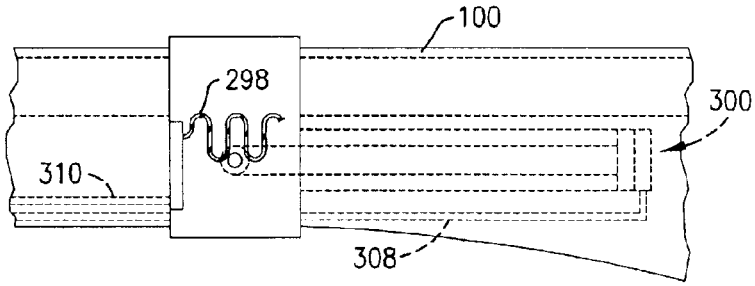
FIG. 36 is a greatly enlarged, fragmentary view illustrating the construction of the curtain mechanism of FIGS. 32–35, in its retracted position.
Figure 37:
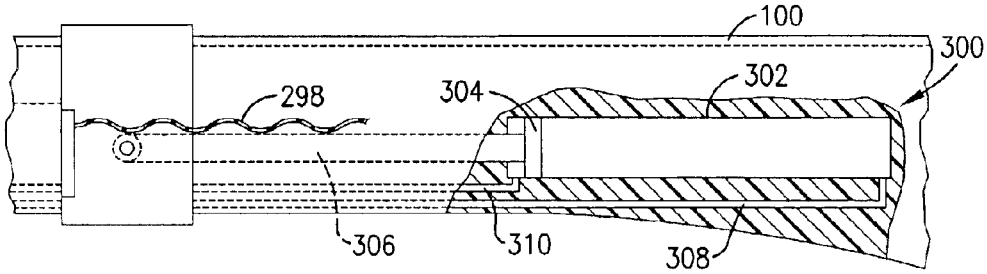
FIG. 37 is a view similar to that of FIG. 36, but with certain parts broken away and showing the curtain mechanism in its deployed position.
Figure 38:
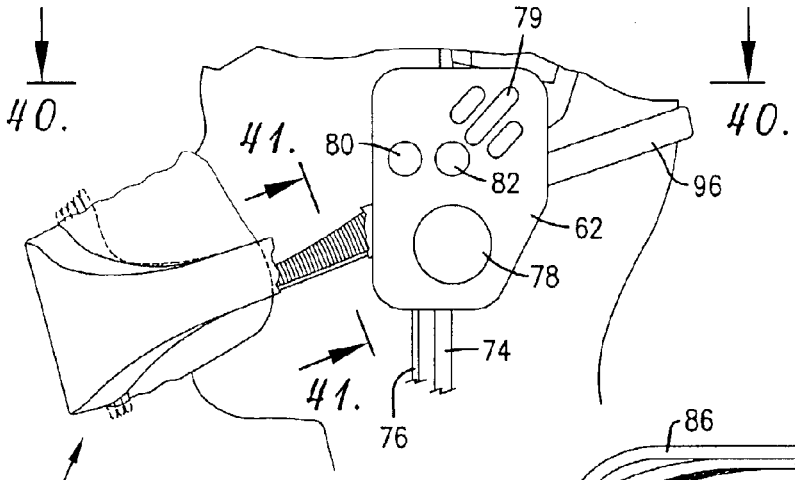
FIG. 38 is a fragmentary side view of a headset in accordance with the invention, employing a mask unit having a brush-type face sealing unit.
Figure 39:
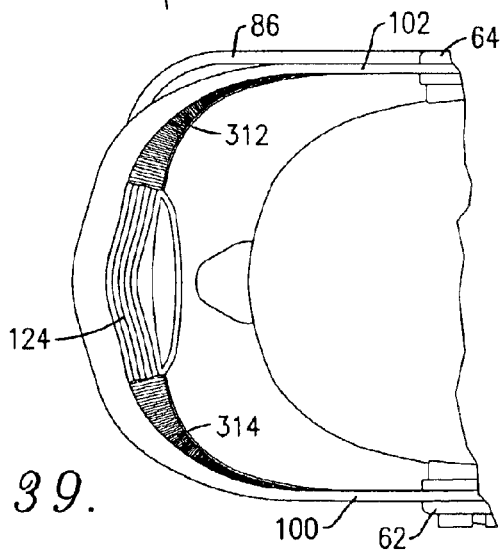
FIG. 39 is a fragmentary top view of the headset shown in FIG. 38.
Figure 40:
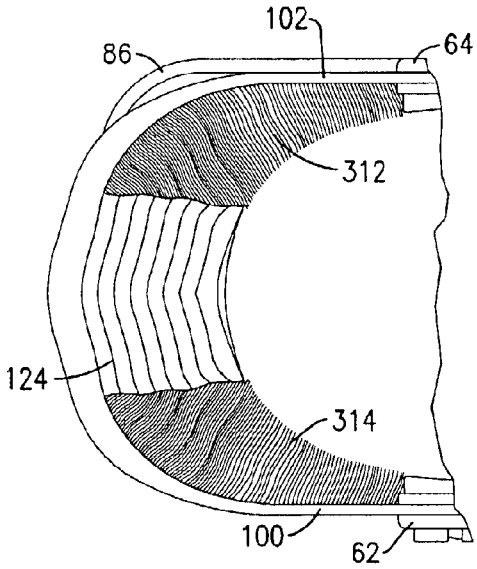
FIG. 40 is a sectional view taken along line 40—40 of FIG. 38, and showing the mask and brush unit fully deployed.
Figure 41:
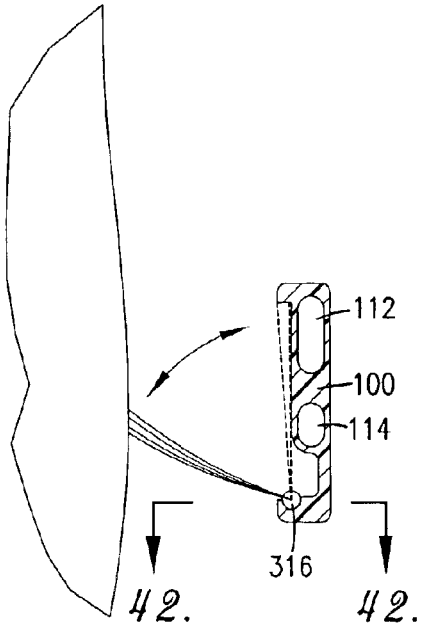
FIG. 41 is a sectional view taken along line 41—41 of FIG. 38, and depicting the engagement between the brush unit and the face of the user.
Figure 42:
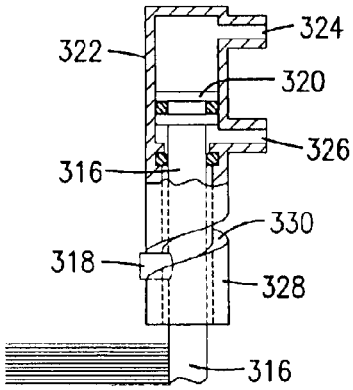
FIG. 42 is a sectional view taken along line 42—42 of FIG. 41, and depicting the operator associated with the brush unit.
Figure 43:
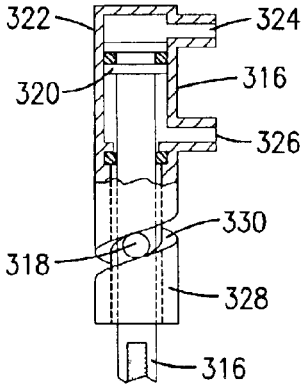
FIG. 43 is a view similar to that of FIG. 42, showing the operator in the retracted condition of the brush unit.

FIGS. 32–37 illustrate a modified embodiment in accordance with the invention, wherein the mask unit 54 has the central mask 124, but with a pair of flexible synthetic resin or elastomeric skirts 296,298 secured to the opposite side margins of the mask body. Additionally, each of the arms 100, 102 is equipped with a substantially flat piston and cylinder assembly 300, cylinder 302, piston 304 and selectively extensible piston rod 306; the rod 306 is in turn coupled with the adjacent skirt 296 or 298. Appropriate pneumatic passageways 308, 310 extend from opposite ends of the cylinder 302, and communicate with appropriate conduits provided in block 198 (not shown). It will be appreciated that the assembly 300 mounted in arm 100 is the master, whereas the assembly 300 mounted in arm 102 is a slave. Referring to FIGS. 36 and 37, it will be seen that in the retracted position, the skirts 296, 298 are spaced forwardly from the user's face. However, when deployed, the skirts are moved rearwardly as best seen in FIG. 35, in order to engage the cheek regions of the user.

FIGS. 38–43 depict a still further embodiment in accordance with the invention. In this instance, a pair of bristle assemblies 312, 314 are provided on opposite sides of the mask body 124. The assemblies 312, 314 are designed to be moved from the retracted position thereof shown in phantom in FIG. 41 in close adjacency to the associated arms 100, 102, to the deployed position. Such movement is effected by the mechanism illustrated in FIGS. 42 and 43. Specifically, each of the bristle assemblies is mounted on a rotatable shaft 316 equipped with an outwardly projecting lug 318. The end of the shaft 316 is coupled with piston 320, housed within a pneumatic cylinder 322 having ports 324, 326. The cylinder includes an elongated, tubular extension 328 having a spiral groove 330 formed therein. The ports 324, 326 are operably coupled with the pneumatic system for the mask, so that, when it is desired to deploy the bristle assemblies 312, 314, pressurized oxygen is directed to the ports 324, thereby causing the shaft 316 to follow the arcuate path defined by groove 330; this causes the brush units to move from their retracted positions to their operative, lowered positions shown in FIGS. 40 and 41, where the inner ends of the bristles engage the user's face. Retraction of the bristle assemblies involves simply a reversal of the foregoing procedure, so that the shafts 316 rotate in the opposite direction to move the associated bristle assemblies to their stored positions. FIGS. 44, 47 and 46, 49 depict other types of controllers which can be used in lieu of the previously described controllers 148 and 149. Turning first to FIGS. 44 and 47, it will be observed that the controllers 332, 334 for the mask and visor units includes a valve 154 as previously described, together with oxygen inlets 156, lines 158, 160 and outlet lines 158*a*, 160*a* and exhaust lines 161. In this case, the only operator for the valve assemblies 154 are the actuator buttons 80, 82. That is, this embodiment does not include any automatic operation as in the case of controllers 148, 149.

Referring to FIGS. 46 and 48, the controllers 336 and 338 for the mask and visor units are identical with the assemblies 332, 334, with the exception that automatic control is provided by means of a voice signal-actuated operator 340. That is, actuation of the valve assemblies 154 may be effected manually by manipulation of the buttons 80, 82, through the aneroids 162, solenoid/smoke detector 163 or by the user simply speaking the appropriate command such as "drop mask" or "drop visor." In all other respects, the operation of these controllers is identical to that described in connection with FIGS. 45 and 48.

We claim:

1. A headset comprising:

a mounting assembly adapted to be worn on a user's head; and a mask unit supported by said mounting assembly and including a mask body configured to cover at least the nose and mouth region of said user, said mask unit movable between a retracted position where the mask body is proximal to the crown of the user's head, and a deployed position where the mask body is adjacent said nose and mouth region;

motive and control assembly means operatively coupled with said mask unit for automatic translatory movement of the mask unit from said retracted position to said deployed position without manual translatory movement of the mask unit by the user; and a detector for detecting a predetermined parameter external from said mask, said detector being operably coupled with said motive and control assembly means for automatically initiating movement of the mask unit from said retracted position to said deployed position in response to detection of the parameter and independent from any user input, said mask unit including a gas delivery passageway operable to deliver breathable gas to the mask body when the mask body is in said deployed position thereof.

2. The headset of claim 1, said mounting assembly comprising a pair of opposed ear pieces, and an elongated, stationary arcuate strap secured to said ear pieces and configured to pass over the crown of the user's head.

3. The headset of claim 2, said mounting assembly including a movable arcuate strap shiftable between a retracted position proximal to said stationary strap and a deployed position wherein the movable strap passes around the back of the user's head.

4. The headset of claim 1, said mounting assembly comprising a pair of opposed ear pieces, with a pair of fixed, arcuate straps secured to said ear pieces and respectively extending over the crown of the user's head, and around the back of the user's head.

5. The headset of claim 1, said mounting assembly comprising a pair of opposed ear pieces, with an arcuate skull cap body secured to the ear pieces and configured for extending over the rear half of the user's head.

6. The headset of claim 1, said mounting assembly comprising a pair of opposed ear pieces, with a pair of fixed, arcuate straps secured to said ear pieces, one of said straps extending around the back of the user's head, and the other of said straps extending upwardly from the ear pieces at an oblique angle relative to the one strap.

7. The headset of claim 1, including a visor unit supported by said mounting assembly and shiftable between a retracted position where the visor is proximal to the crown of the user's head and a deployed position covering the eyes of the user.

8. The headset of claim 7, said visor unit in the deployed position thereof being disposed atop said mask body.

9. The headset of claim 7, said visor including an upper periphery, there being a device adjacent such upper periphery for inhibiting entrance of smoke into the visor.

10. The headset of claim 9, said device comprising a series of gas outlet openings along said upper periphery, and a conduit for delivery of pressurized gas to said outlet openings.

11. The headset of claim 9, said device comprising selectively inflatable bellows which in the inflated condition thereof will engage the forehead of the user.

12. The headset of claim 1, said mask unit having a collapsed configuration when the mask unit is in said retracted position, said mask unit movable to a face-engaging position when the mask unit is moved to said, deployed position.

13. The headset of claim 12, said mask body including inflatable bellows, there being a pressurized gas conduit operably coupled with said bellows for selected inflation thereof when the mask body is in said deployed position.

14. The headset of claim 1, including sealing structure disposed on opposite sides of said mask body and operable to prevent entrance of smoke.

15. The headset of claim 14, said sealing structure comprising flexible skirt sections secured to opposite sides of said mask body, and an operator coupled with said skirt sections for moving the skirt sections to engage the face of the user.

16. The headset of claim 14, said sealing structure comprising a pair of brush sections on opposite sides of said mask body, and an operator coupled with the brush sections for moving the latter to engage the face of the user.

17. The headset of claim 14, said mask unit comprising an arcuate, pivotally mounted arm supporting mask body, said sealing structure comprising a series of gas outlet openings along the length of said arm, and a pressurized gas conduit community with the openings for delivery of pressurized gas thereto.

18. The headset of claim 1, said motive and control assembly means coupled with said mask unit for said selective automatic movement thereof between said retracted and deployed positions.

19. The headset of claim 18, said motive and control assembly means including a controller and a driver, the driver operably connected with said mask unit.

20. The headset of claim 19, said driver including a shiftable rack and a mating gear coupled with said mask unit, said controller including a pneumatic valve assembly for selective shifting of the rack.

21. The headset of claim 20, said rack operably coupled with a pneumatic cylinder, said pneumatic valve assembly coupled with the cylinder.

22. The headset of claim 19, the driver including a piston and cylinder assembly, the rod of said assembly operably coupled with an elongated tie element connected to said mask unit, said controller comprising a pneumatic valve assembly coupled with said piston and cylinder assembly.

23. The headset of claim 19, the driver comprising a pair of relatively shiftable, slotted disks cooperatively defining a pneumatic chamber, said controller comprising a pneumatic valve assembly coupled with said chamber whereby upon application of pressurized gas in said chamber, at least one of said disks shift relative to the other disk.

24. The headset of claim 19, said driver comprising a pair of intermeshed gears, one of said gears coupled with said mask unit, an electric drive motor coupled with said one gear and electrical circuitry for selective operation of said drive motor.

25. The headset of claim 19, said controller comprising a pneumatic valve assembly, said valve assembly being manually operable.

26. The headset of claim 25, said valve assembly including an override for automatic operation of the valve assembly.

27. The headset of claim 26, said override comprising an aneroid.

28. The headset of claim 26, said override including a voice-actuated operator.

29. The headset of claim 1, said motive and control assembly operable for translatory movement of the mask unit from said deployed position to said retracted position without manual translatory movement of the mask unit by the user.

30. A headset comprising:

a mounting assembly adapted to be worn on a user's head;

a visor unit supported by said mounting assembly and including a visor configured to cover the eyes of said user, said visor unit movable between a retracted position where the visor unit is proximal to the crown of the user's head, and a deployed position where the visor unit is covering the eyes of said user;

motive and control assembly means operably coupled with said visor unit for selective automatic translatory movement thereof between said retracted and deployed positions thereof without manual translatory movement of the visor unit by the user; and a detector for detecting a predetermined parameter external from said mask, said detector being operably coupled with said motive and control assembly means for automatically initiating movement of the visor unit from said retracted position to said deployed position in response to detection of the parameter and independent from any user input.

31. The headset of claim 30, said mounting assembly comprising a pair of opposed ear pieces, with an elongated, stationary arcuate strap secured to said ear pieces and configured to pass over the crown of the user's head.

32. The headset of claim 31, said mounting assembly including a movable arcuate strap shiftable between a retracted position proximal to said stationary strap and a deployed position wherein the movable strap passes around the back of the user's head.

33. The headset of claim 30, said mounting assembly comprising a pair of opposed ear pieces, with an arcuate skull cap body secured to the ear pieces and configured for extending over the rear half of the user's head.

34. The headset of claim 30, said mounting assembly comprising a pair of opposed ear pieces, with a pair of fixed, arcuate straps secured to said ear pieces, one of said straps extending around the back of the user's head, and the other of said straps extending upwardly from the ear pieces at an oblique angle relative to the one strap.

35. The headset of claim 30, said visor including an upper periphery, there being a device adjacent such upper periphery for inhibiting entrance of smoke into the visor.

36. The headset of claim 35, said device comprising a series of gas outlet openings along said upper periphery, and a conduit for delivery of pressurized gas to said outlet openings.

37. The headset of claim 35, said device comprising selectively inflatable bellows which in the inflated condition thereof will engage the forehead of the user.

38. The headset of claim 30, said motive and control assembly including a controller and a driver, the driver operably connected with said visor unit.

39. The headset of claim 38, said driver including a shiftable rack and a mating gear coupled with said mask unit, said controller including a pneumatic valve assembly for selective shifting of the rack.

40. The headset of claim 39, said rack operably coupled with a pneumatic cylinder, said pneumatic valve assembly coupled with the cylinder.

41. The headset of claim 38, the driver including a piston and cylinder assembly, the rod of said assembly operably coupled with an elongated tie element connected to said visor, said controller comprising a pneuniatic valve assembly coupled with said piston and cylinder assembly.

42. The headset of claim 38, the driver comprising a pair of relatively shiftable, slotted disks cooperatively defining a pneumatic chamber, said controller comprising a pneumatic valve assembly coupled with said chamber whereby upon application of pressurized gas in said chamber, at least one of said disks shift relative to the other disk.

43. The headset of claim 38, said driver comprising a pair of intermeshed gears, one of said gears coupled with said mask unit, an electric chive motor coupled with said one gear and electrical circuitry for selective operation of said drive motor.

44. The headset of claim 38, said controller comprising a pneumatic valve assembly, said valve assembly being manually operable.

45. The headset of claim 44, said valve assembly including an override for automatic operation of the valve assembly.

46. The headset of claim 45, said override comprising an aneroid.

47. The headset of claim 45, said override including a voice-actuated operator.

48. The headset of claim 30, said mounting assembly comprising a pair of opposed ear pieces, with a pair of fixed, arcuate straps secured to said ear pieces and respectively extending over the crown of the user's head, and around the back of the user's head.

49. The headset of claim 30, said motive and control assembly operable for translatory movement of the mask unit from said deployed position to said retracted position without manual translatory movement of the mask unit by the user.

50. A headset comprising:

a mask unit including a mask body configured to cover at least the nose and mouth region of a user;

means for mounting said mask unit on said user's head; and means for automatic, translatory moving of said mask unit without manual translatory movement of the mask unit by the user between a retracted position where the mask body is proximal to the crown of the user's head, and a deployed position where the mask body is adjacent said nose and mouth region; and a detector for detecting a predetermined parameter said external from said mask, detector being operably coupled with said moving means for automatically initiating movement of the mask unit from said retracted position to said deployed position in response to detection of the parameter and independent from any user input, said mask unit including a gas delivery passageway operable to deliver breathable gas to the mask body when the mask body is in said deployed position thereof.

51. The headset of claim 50, said mounting means comprising a pair of opposed ear pieces, with an arcuate skull cap body secured to the ear pieces and configured for extending over the rear half of the user's head.

52. The headset of claim 50, said mounting means comprising a pair of opposed ear pieces, with a pair of fixed, arcuate straps secured to said ear pieces, one of said straps extending around the back of the user's head, and the other of said straps extending upwardly from the ear pieces at an oblique angle relative to the one strap.

53. The headset of claim 50, including visor means supported by said mounting means and shiftable between a retracted position where the visor is proximal to the crown of the user's head and a deployed position covering the eyes of the user.

54. The headset of claim 53, said visor means in the deployed position thereof being disposed atop said mask body.

55. The headset of claim 53, said visor means including an upper periphery, there being means adjacent such upper periphery for inhibiting entrance of smoke into the visor.

56. The headset of claim 55, said smoke entrance-inhibiting means comprising a series of gas outlet openings along said upper periphery, and a conduit for delivery of pressurized gas to said outlet openings.

57. The headset of claim 55, said smoke entrance-inhibiting means comprising selectively inflatable bellows which in the inflated condition thereof will engage the forehead of the user.

58. The headset of claim 50, said mask unit having a collapsed configuration when the mask unit is in said retracted position, said mask unit movable to a face-engaging position when the mask unit is moved to said deployed position.

59. The headset of claim 58, said mask body including inflatable bellows, there being a pressurized gas conduit operably coupled with said bellows for selected inflation thereof when the mask body is in said deployed position.

60. The headset of claim 50, including a said seal disposed on opposite sides of said mask body and operable to prevent entrance of smoke.

61. The headset of claim 60, said seal comprising flexible skirt sections secured to opposite sides of said mask body, and an operator coupled with said skirt sections for moving the skirt sections to engage the face of the user.

62. The headset of claim 60, said seal comprising a pair of brush sections on opposite sides of said mask body, and an operator coupled with the brush sections for moving the latter to engage the face of the user.

63. The headset of claim 60, said mask unit comprising an arcuate, pivotally mounted arm supporting mask body, said seal comprising a series of gas outlet openings along the length of said arm, and a pressurized gas conduit community with the openings for delivery of pressurized gas thereto.

64. The headset of claim 50, said mounting means including a pair of ear pieces, there being motive and control means carried in one of said ear pieces, said motive and control means operably coupled with said mask unit for selective movement thereof between said retracted and deployed positions.

65. The headset of claim 64, said motive and control means including a controller and a driver, the driver operably connected with said mask unit.

66. The headset of claim 65, said driver including a shiftable rack and a mating gear coupled with said mask unit, said controller including a pneumatic valve assembly for selective shifting of the rack.

67. The headset of claim 66, said rack operably coupled with a pneumatic cylinder, said pneumatic valve assembly coupled with the cylinder.

68. The headset of claim 65, the driver including a piston and cylinder assembly, the rod of said assembly operably coupled with an elongated tie element connected to said mask unit, said controller comprising a pneumatic valve assembly coupled with said piston and cylinder assembly.

69. The headset of claim 65, the driver comprising a pair of relatively shiftable, slotted disks cooperatively defining a pneumatic chamber, said controller comprising a pneumatic valve assembly coupled with said chamber whereby upon application of pressurized gas in said chamber, at least one of said disks shift relative to the other disk.

70. The headset of claim 65, said driver comprising a pair of intermeshed gears, one of said gears coupled with said mask unit, an electric drive motor coupled with said one gear and electrical circuitry for selective operation of said drive motor.

71. The headset of claim 65, said controller comprising a pneumatic valve assembly, said valve assembly being manually operable.

72. The headset of claim 71, said valve assembly including an override for automatic operation of the valve assembly.

73. The headset of claim 72, said override comprising an aneroid.

74. The headset of claim 50, said mounting means including a stationary arcuate strap and a movable arcuate strap shiftable between a retracted position proximal to said stationary strap and a deployed position wherein the movable strap passes around the back of the user's head.

75. The headset of claim 50, said mounting means comprising a pair of opposed ear pieces, with a pair of fixed, arcuate straps secured to said ear pieces and respectively extending over the crown of the user's head, and around the back of the user's head.

76. The headset of claim 50, said mask unit moving means operable for translatory movement of the mask unit from said deployed position to said retracted position without manual translatory movement of the mask unit by the user.

77. A headset, comprising:

a mounting assembly adapted to be worn on a user's head;

a unit supported by said mounting assembly and comprising a component selected from the group consisting of a mask body, a visor, and a combination thereof, said unit movable between a retracted position where the unit is proximal to the crown of the user's head, and a deployed position beneath the retracted position and adjacent the user's face;

a motive and control assembly comprising a driver coupled with said unit for selective automatic translatory movement of the unit from said retracted position to said deployed position without manual translatory movement of the unit by the user, and a controller coupled with the driver to initiate driver operation in order to move said unit; and a detector for detecting a predetermined parameter external from said mask, said detector being operably coupled with said controller for automatically initiating movement of the unit from said retracted position to said deployed position in response to detection of the parameter and independent from any user input.

78. The headset of claim 77, said mask unit being a mask body.

79. The headset of claim 77, said driver comprising a mechanical drive.

80. The headset of claim 77, said controller comprising comprising a pneumatic valve.

81. The headset of claim 77, said driver operable for translatory movement of the unit from said deployed position to said retracted position without manual translatory movement of the unit by the user.

82. The headset of claim 77, said detector being selected from the group consisting of a pressure-responsive aneroid and a solenoid/smoke detector.

83. A headset comprising:

a mounting assembly adapted to be worn on a user's head;

a mask unit supported by said mounting assembly and including a mask body configured to cover at least the nose and mouth region of said user, said mask unit movable between a retracted position where the mask body is proximal to the crown of the user's head, and a deployed position where the mask body is adjacent said nose and mouth region;

motive and control assembly means operatively coupled with said mask unit for automatic translatory movement of the mask unit from said retracted position to said deployed position without manual translatory movement of the mask unit by the user, said mask unit including a gas delivery passageway operable to deliver breathable gas to the mask body when the mask body is in said deployed position thereof; and a visor unit supported by said mounting assembly and shiftable between a retracted position where the visor is proximal to the crown of the user's head and a deployed position covering the eyes of the user, said visor including an upper periphery, there being a device adjacent such upper periphery for inhibiting entrance of smoke into the visor, said device comprising a series of gas outlet openings along said upper periphery, and a conduit for delivery of pressurized gas to said outlet openings.

84. A headset comprising:

a mounting assembly adapted to be worn on a user's head;

a mask unit supported by said mounting assembly and including a mask body configured to cover at least the nose and mouth region of said user, said mask unit movable between a retracted position where the mask body is proximal to the crown of the user's head, and a deployed position where the mask body is adjacent said nose and mouth region;

motive and control assembly means operatively coupled with said mask unit for automatic translatory movement of the mask unit from said retracted position to said deployed position without manual translatory movement of the mask unit by the user, said mask unit including a gas delivery passageway operable to deliver breathable gas to the mask body when the mask body is in said deployed position thereof; and sealing structure disposed on opposite sides of said mask body and operable to prevent entrance of smoke, said sealing structure comprising flexible skirt sections secured to opposite sides of said mask body, and an operator coupled with said skirt sections for moving the skirt sections to engage the face of the user.

85. A headset comprising:

a mounting assembly adapted to be worn on a user's head;

a mask unit supported by said mounting assembly and including a mask body configured to cover at least the nose and mouth region of said user, said mask unit movable between a retracted position where the mask body is proximal to the crown of the user's head, and a deployed position where the mask body is adjacent said nose and mouth region;

motive and control assembly means operatively coupled with said mask unit for automatic translatory movement of the mask unit from said retracted position to said deployed position without manual translatory movement of the mask unit by the user, said mask unit including a gas delivery passageway operable to deliver breathable gas to the mask body when the mask body is in said deployed position thereof; and sealing structure disposed on opposite sides of said mask body and operable to prevent entrance of smoke, said mask unit comprising an arcuate, pivotally mounted arm supporting mask body, said sealing structure comprising a series of gas outlet openings along the length of said arm, and a pressurized gas conduit community with the openings for delivery of pressurized gas thereto.

86. A headset comprising:

a mounting assembly adapted to be worn on a user's head;

a visor unit supported by said mounting assembly and including a visor configured to cover the eyes of said user, said visor unit movable between a retracted position where the visor unit is proximal to the crown of the user's head, and a deployed position where the visor unit is covering the eyes of said user; and motive and control assembly means operably coupled with said visor unit for selective automatic translatory movement thereof between said retracted and deployed positions thereof without manual translatory movement of the visor unit by the user, said visor including an upper periphery, there being a device adjacent such upper periphery for inhibiting entrance of smoke into the visor, said device comprising a series of gas outlet openings along said upper periphery, and a conduit for delivery of pressurized gas to said outlet openings.

87. A headset comprising:

a mask unit including a mask body configured to cover at least the nose and mouth region of a user;

means for mounting said mask unit on said user's head;

means for automatic, translatory moving of said mask unit without manual translatory movement of the mask unit by the user between a retracted position where the mask body is proximal to the crown of the user's head, and a deployed position where the mask body is adjacent said nose and mouth region, said mask unit including a gas delivery passageway operable to deliver breathable gas to the mask body when the mask body is in said deployed position thereof; and visor means supported by said mounting means and shiftable between a retracted position where the visor is proximal to the crown of the user's head and a deployed position covering the eyes of the user, said visor means including an upper periphery, there being means adjacent such upper periphery for inhibiting entrance of smoke into the visor, said smoke entrance-inhibiting means comprising a series of gas outlet openings along said upper periphery, and a conduit for delivery of pressurized gas to said outlet openings.

88. A headset comprising:

a mask unit including a mask body configured to cover at least the nose and mouth region of a user;

means for mounting said mask unit on said user's head;

means for automatic, translatory moving of said mask unit without manual translatory movement of the mask unit by the user between a retracted position where the mask body is proximal to the crown of the user's head, and a deployed position where the mask body is adjacent said nose and mouth region, said mask unit including a gas delivery passageway operable to deliver breathable gas to the mask body when the mask body is in said deployed position thereof; and a seal disposed on opposite sides of said mask body and operable to prevent entrance of smoke, said seal comprising flexible skirt sections secured to opposite sides of said mask body, and an operator coupled with said skirt sections for moving the skirt sections to engage the face of the user.

89. A headset comprising:

a mask unit including a mask body configured to cover at least the nose and mouth region of a user;

means for mounting said mask unit on said user's head;

means for automatic, translatory moving of said mask unit without manual translatory movement of the mask unit by the user between a retracted position where the mask body is proximal to the crown of the user's head, and a deployed position where the mask body is adjacent said nose and mouth region, said mask unit including a gas delivery passageway operable to deliver breathable gas to the mask body when the mask body is in said deployed position thereof; and a seal disposed on opposite sides of said mask body and operable to prevent entrance of smoke, said mask unit comprising an arcuate, pivotally mounted arm supporting mask body, said seal comprising a series of gas outlet openings along the length of said arm, and a pressurized gas conduit community with the openings for delivery of pressurized gas thereto.

* * * * *